US012578115B2

(12) United States Patent
Moffitt et al.

(10) Patent No.: US 12,578,115 B2
(45) Date of Patent: Mar. 17, 2026

(54) CONTROLLED ROUTING OF HYDRONIC FLOW USING A DISTRIBUTION AREA DIRECTOR

(71) Applicant: Trane International Inc., Davidson, NC (US)

(72) Inventors: Ronnie R. Moffitt, Harrodsburg, KY (US); Brian J. Fiegen, La Crosse, WI (US); Lee R. Cline, West Salem, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 644 days.

(21) Appl. No.: 17/937,088

(22) Filed: Sep. 30, 2022

(65) Prior Publication Data

US 2024/0110720 A1 Apr. 4, 2024

(51) Int. Cl.
*F24F 11/84* (2018.01)
*F24D 10/00* (2022.01)
(Continued)

(52) U.S. Cl.
CPC ..... *F24F 11/84* (2018.01); *F24D 19/1015* (2013.01); *F24F 11/54* (2018.01);
(Continued)

(58) Field of Classification Search
CPC .. F24F 11/84; F24F 11/54; F24F 11/63; F24F 2140/20; F24F 11/30; F24D 10/00;
(Continued)

(56) References Cited

U.S. PATENT DOCUMENTS 6,062,485 A 5/2000 Stege et al.
2012/0018129 A1 1/2012 Ushijima et al.
(Continued)

FOREIGN PATENT DOCUMENTS

DE 202010016095 U1 3/2011
EP 3492822 B1 9/2020
WO 2018015508 A1 1/2018

OTHER PUBLICATIONS

Innovation Meets Energy Efficient Design. Belimo Air Controls (USA), Inc, Belimo Americas. Accessed from the Internet 2022.
(Continued)

*Primary Examiner* — Kamini S Shah
*Assistant Examiner* — Zachary Andrew Cain
(74) *Attorney, Agent, or Firm* — Womble Bond Dickinson (US) LLP

(57) ABSTRACT

A method is provided for the controlled routing of hydronic flow within a climate control system. The method includes determining a condition type request for a plurality of area zones corresponding to a particular thermal zone. The method further includes determining a supply temperature type associated with at least a supply line of a primary supply loop and a supply line of a secondary supply loop. The supply temperature type is indicative of a thermal transport fluid temperature within the respective supply line. The method further includes providing an actuation signal set to a valve assembly. The actuation signal set is configured to describe a position for each value of the valve assembly and the position for each valve is based on the conditioning type request and the determined supply temperature types.

25 Claims, 14 Drawing Sheets

(51) Int. Cl.

| | |
|---|---|
| ***F24D 19/10*** | (2006.01) |
| ***F24F 11/54*** | (2018.01) |
| ***F24F 11/63*** | (2018.01) |
| ***F24F 140/20*** | (2018.01) |

(52) U.S. Cl.
CPC ..... *F24F 11/63* (2018.01); *F24D 10/00* (2013.01); *F24F 2140/20* (2018.01)

(58) Field of Classification Search
CPC ..... F24D 2200/13; F24D 2220/0242; F24D 2220/0292; F24D 19/1024; F24D 19/1033; F24D 19/1015; F24H 15/156; F24H 15/254; F24H 15/414; F24H 15/32; F24H 15/45
See application file for complete search history.

(56) References Cited

U.S. PATENT DOCUMENTS

| | | | | |
|---|---|---|---|---|
| 2017/0030593 | A1* | 2/2017 | O'Connor | F24D 19/10 |
| 2017/0067665 | A1 | 3/2017 | Whitmore et al. | |
| 2018/0239371 | A1* | 8/2018 | Drees | F16K 11/0873 |
| 2021/0325069 | A1* | 10/2021 | Cotton | F24F 5/0021 |
| 2022/0290879 | A1* | 9/2022 | Fischer | F24F 11/85 |
| 2022/0368257 | A1* | 11/2022 | Lovati | H02P 6/08 |
| 2023/0189483 | A1* | 6/2023 | Gil | H04L 67/12 361/695 |

OTHER PUBLICATIONS

Extended European Search Report, EP Application 23200766.6, dated Feb. 13, 2024.

* cited by examiner

1400

| 1401 Primary Supply Loop: Supply Temperature Type | 1402 Secondary Supply Loop: Supply Temperature Type | 1403 Condition Type Request | 1404 Selected Actuation Signal Set |
|---|---|---|---|
| COLD | HOT | HEATING | SECONDARY |
| HOT | HOT | HEATING | PRIMARY |
| NEUTRAL | HOT | HEATING | SECONDARY |
| HOT | NEUTRAL | HEATING | PRIMARY |
| COLD | NEUTRAL | HEATING | CLOSED |
| NEUTRAL | NEUTRAL | HEATING | CLOSED |
| HOT | COLD | HEATING | PRIMARY |
| COLD | COLD | HEATING | CLOSED |
| NEUTRAL | COLD | HEATING | CLOSED |
| | | | |
| COLD | HOT | COOLING | PRIMARY |
| HOT | HOT | COOLING | CLOSED |
| NEUTRAL | HOT | COOLING | CLOSED |
| HOT | NEUTRAL | COOLING | CLOSED |
| COLD | NEUTRAL | COOLING | PRIMARY |
| NEUTRAL | NEUTRAL | COOLING | CLOSED |
| HOT | COLD | COOLING | SECONDARY |
| COLD | COLD | COOLING | PRIMARY |
| NEUTRAL | COLD | COOLING | SECONDARY |

FIG. 14

CONTROLLED ROUTING OF HYDRONIC FLOW USING A DISTRIBUTION AREA DIRECTOR

TECHNOLOGICAL FIELD

The present disclosure relates generally to climate control system engineering and, in particular, to one or more of the design, construction, operation, or use of climate control systems.

BACKGROUND

Climate control system, such as heating, ventilation, and air conditioning (HVAC) systems typically rely on refrigerant to transport heat across a temperature gradient. An HVAC system is generally configured to control environmental conditions for a facility such as an industrial facility, institutional facility, commercial facility, residential facility and the like. The facility may also include a building automation system (BAS) or other control system to provide some level of computerized central control of an HVAC system and perhaps other environmental control systems of the facility.

It is desirable to operate an HVAC system such that the conditioned air, provided to one or more enclosed spaces, maintains the relative comfort of the occupants of those enclosed spaces. As will be appreciated, factors affecting the occupants' comfort include the temperature and humidity maintained in those enclosed spaces. In certain situations, a desirable temperature and humidity can be achieved by controlling the routing of hydronic flow supplied to heat exchangers. As will also be appreciated, then, it is desirable to properly control the routing of such a hydronic flow system, in order to maintain such desirable temperatures and humidity levels.

BRIEF SUMMARY

Example implementations of the present disclosure are directed to the design, construction, operation, or use of climate control systems. In terms of the present disclosure, climate control systems that employ hydronic flow controlled routing techniques can benefit from techniques such as those described herein, which provide a distribution area director for use in climate control systems employing such hydronic flow controlled routing techniques.

Some example implementations provide for A method for controlling routing of hydronic flow within a climate control system. The method includes determining a condition type request for a plurality of area zones corresponding to a particular thermal zone. The method further includes determining a supply temperature type associated with at least a supply line of a primary supply loop and a supply line of a secondary supply loop, wherein: the supply temperature type is indicative of a thermal transport fluid temperature within the respective supply line. The method further includes providing an actuation signal set to a valve assembly, wherein the actuation signal set is configured to describe a position for each valve of the valve assembly associated with the particular thermal zone, the position for each valve is based on the conditioning type request and the determined supply temperature types, and the valve assembly is fluidically coupled at least to the supply line of the primary supply loop, the supply line of the secondary supply loop, and a supply line for an area zone primary unit for each of the plurality of area zones.

Some example implementations provide an apparatus for controlled routing of hydronic flow within a climate control system, which can include a primary supply loop, a secondary supply loop, a plurality of area zone primary units, a valve assembly, and a distribution area controller. The primary supply loop includes a supply line and a return line. The secondary supply loop includes a supply line and a return line. Each area zone primary unit is associated with an area zone of a plurality of area zones and each area zone corresponds to a particular thermal zone. The valve assembly comprises one or more valves configured to control a flow of thermal transport fluid between two corresponding lines and the valve assembly is fluidically coupled at least to the supply line of the primary supply loop, the supply line of the secondary supply loop, and the supply line for the area zone primary unit for each of the plurality of area zones. The distribution area direction controller is configured to: determine a condition type request for the plurality of area zones; determine a supply temperature type associated with at least the supply line of the primary supply loop and the supply line of the secondary supply loop, wherein: the supply temperature type is indicative of a thermal transport fluid temperature within the respective supply line; and provide an actuation signal set to a valve assembly, wherein: the actuation signal set is configured to describe a position for each valve of the valve assembly associated with the particular thermal zone, and the position for each valve is based on the conditioning type request and the determined supply temperature types.

Some example implementations provide for a computer-readable storage medium for controlled routing of hydronic flow within a climate control system, the computer-readable storage medium being non-transitory and having computer-readable program code including a software application stored therein that, in response to execution by processor, causes an apparatus to at least: determine a condition type request for a plurality of area zones corresponding to a particular thermal zone; determine a supply temperature type associated with at least a supply line of a primary supply loop and a supply line of a secondary supply loop, wherein: the supply temperature type is indicative of a thermal transport fluid temperature within the respective supply line; and provide an actuation signal set to a valve assembly, wherein: the actuation signal set is configured to describe a position for each valve of the valve assembly associated with the particular thermal zone, the position for each valve is based on the conditioning type request and the determined supply temperature types, and the valve assembly is fluidically coupled at least to the supply line of the primary supply loop, the supply line of the secondary supply loop, and a supply line for an area zone primary unit for each of the plurality of area zones.

Some example implementations provide for a climate control system for controlled routing of hydronic flow, comprising: a primary supply loop, wherein: the primary supply loop comprises a supply line and a return line; a secondary supply loop, wherein: the secondary supply loop comprises a supply line and a return line; a plurality of area zones primary units, wherein: each area zone primary unit is associated with an area zone of a plurality of area zones and each area zone corresponds to a particular thermal zone; a valve assembly, wherein: the valve assembly comprises one or more valves configured to control a flow of thermal transport fluid between two corresponding lines, and the valve assembly is fluidically coupled at least to the supply line of the primary supply loop, the supply line of the secondary supply loop, and the supply line for the area zone primary unit for each of the plurality of area zones; and a distribution area direction controller, wherein the distribution area direction controller is configured to: determine a condition type request for the plurality of area zones; determine a supply temperature type associated with at least the supply line of the primary supply loop and the supply line of the secondary supply loop, wherein: the supply temperature type is indicative of a thermal transport fluid temperature within the respective supply line; and provide an actuation signal set to a valve assembly, wherein: the actuation signal set is configured to describe a position for each valve of the valve assembly associated with the particular thermal zone, and the position for each valve is based on the conditioning type request and the determined supply temperature types.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURES

Figure 1:
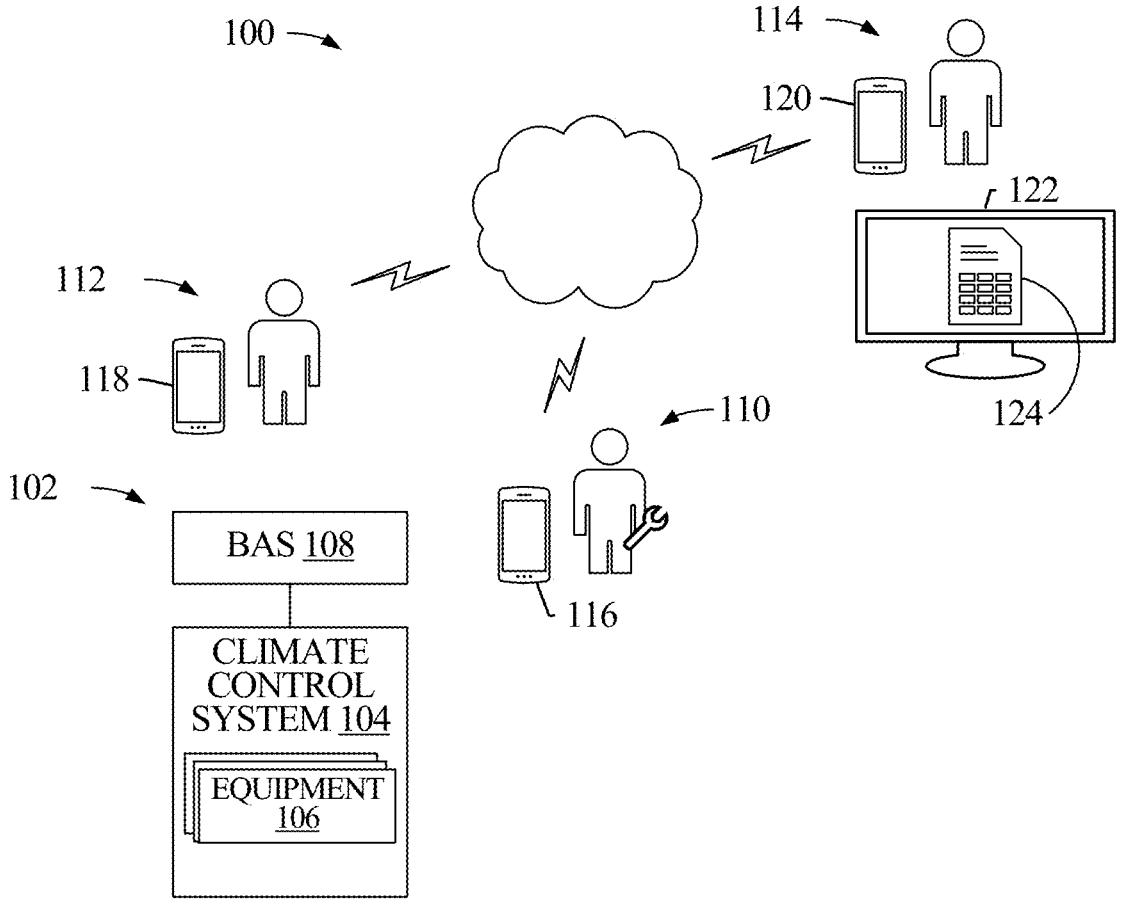

Having thus described example implementations of the disclosure in general terms, reference will now be made to the accompanying figures, which are not necessarily drawn to scale, and wherein:

FIG. 1 illustrates a system for establishing a climate control system, according to some example implementations of the present disclosure.

FIGS. 2, 3, 4, 5, 6, 7, 8, 9, and 10 illustrate certain aspects of various embodiments and implementations of a climate control system such as that depicted in FIG. 1 which is configured with a distribution area director for the controlled routing of hydronic flow, according to some example implementations of the present disclosure.

Figure 11:
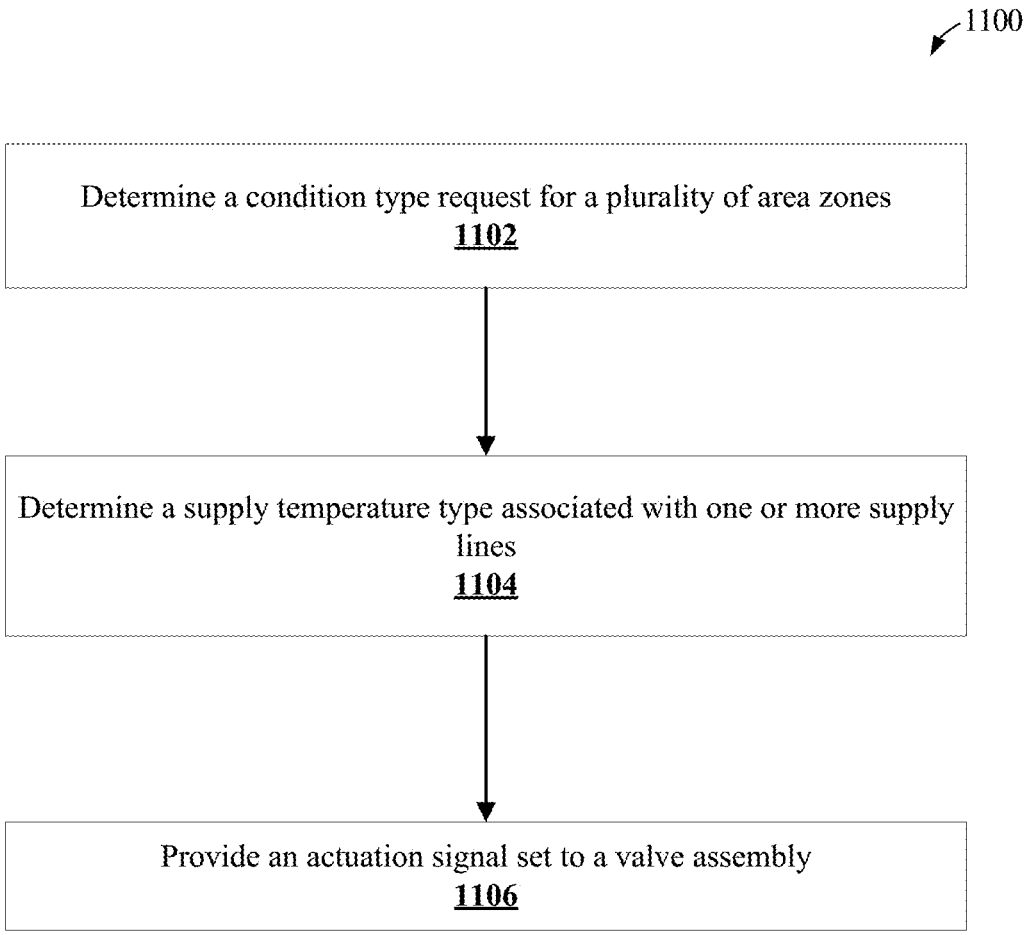

FIG. 11 is a flowchart illustrating various example operations of A method for controlling routing of hydronic flow, according to some example implementations of the present disclosure.

Figure 12:
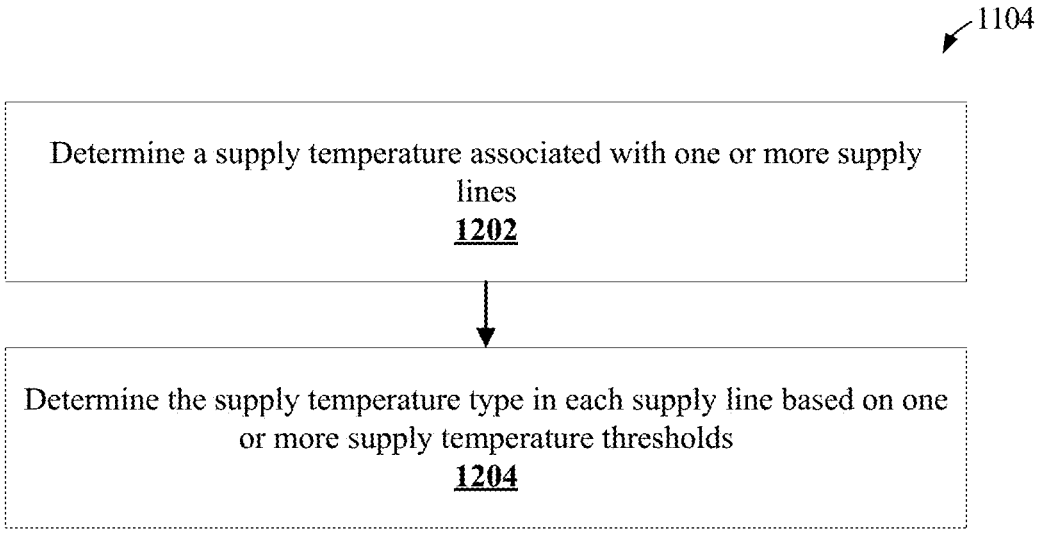

FIG. 12 is a flowchart illustrating various example operations of a method for determining a supply temperature type associated with a supply line, according to some example implementations of the present disclosure.

Figure 13:
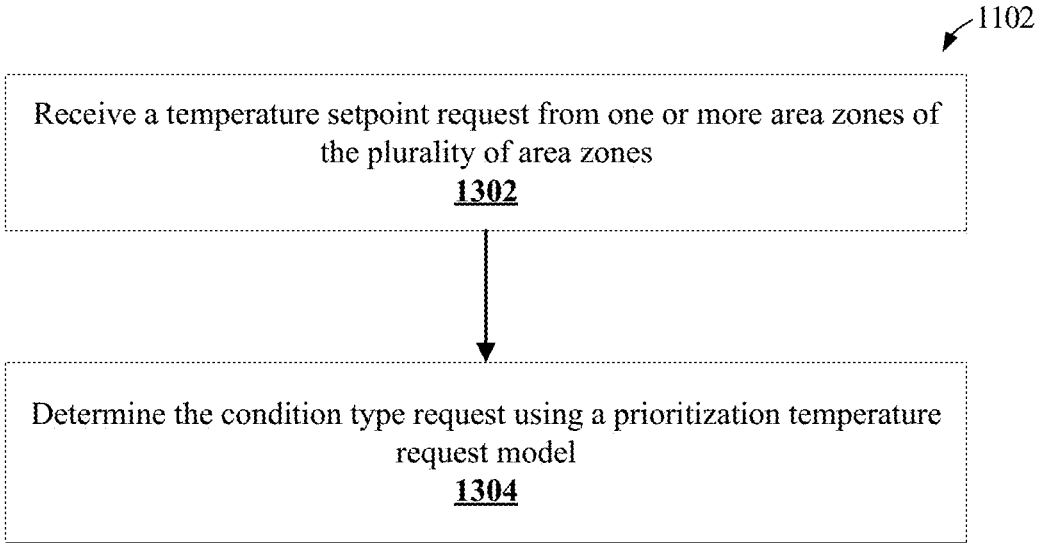

FIG. 13 is a flowchart illustrating various example operations of a method for determining a condition type request for a plurality of area zones corresponding to a particular thermal zone, according to some example implementations of the present disclosure.

FIG. 14 depicts an operational example of logic for generating an actuation signal set, according to some example implementations of the present disclosure.

Figure 15:
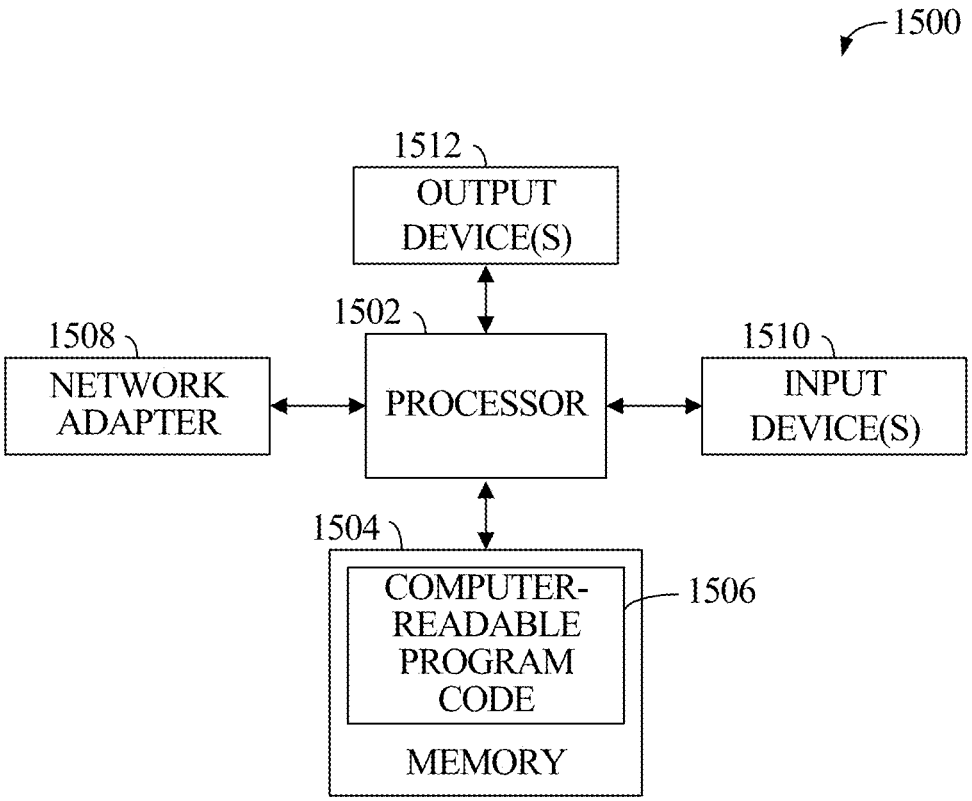

FIG. 15 illustrates computing system suitable for use in certain embodiments of methods and systems such as those disclosed herein, according to some example implementations of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably.

Overview

As indicated above, example implementations of the present disclosure relate generally to a climate control system engineering and, in particular, to one or more of the design, construction, operation or use of climate control systems. In this regard, FIG. 1 illustrates a system 100 for establishing a climate control system project, according to some example implementations. In some embodiments, the climate control system may be a heating, ventilation, and air conditioning (HVAC) system. As shown, the system includes a facility 102 such as an industrial facility, institutional facility, commercial facility, residential facility and the like. In some examples, the facility includes one or more buildings such as industrial buildings, institutional buildings, commercial buildings, residential buildings and the like. Even further, examples of suitable commercial buildings include office buildings, warehouses, retail buildings and the like.

The facility 102 is generally any facility with one or more environmental control systems configured to control environmental conditions for the facility. The environmental control systems may include, for example, a climate control system 104 with equipment 106 such as air handling units, variable air volume (VAV) units, compressors, air movers, chillers, furnaces, and ventilators. Other examples of suitable environmental control systems include lighting control systems, shading control systems, security systems, and the like. The facility may also include an industrial control system (ICS) such as a supervisory control and data acquisition (SCADA) system, distributed control system (DCS) or the like. A more specific example of a suitable DCS is a building automation system (BAS) 108. The ICS is configured to provide some level of computerized central control of at least some of the environmental control systems (including the climate control system system).

In some embodiments, a facility 102 may include a plurality of area zones, which may be a particular room, section, or partitioned area configured with an individual user controller (UC). The UC may provide some level of localized environmental control for the respective area zone. Each area zone may also be configured with local equipment configured to provide conditioning to the respective area zone.

In the context of some example implementations of the present disclosure, the climate control system 104 and perhaps also the BAS 108 may be installed at the facility, and then thereafter be placed in service at the facility. While in service and operated by a customer 112 such as a proprietor of the facility, the climate control system and/or the BAS may be operated by the customer, by the owner of the facility, or by another party providing services with regard to the operation and maintenance of such climate control system systems.

As will also be appreciated, computers are often used throughout the installation and service of the climate control system 104; and in this regard, a "computer" is generally a machine that is programmable or programmed to perform functions or operations. The installation and service of the climate control system 104 at the facility 102 as shown makes use of a number of example computers. These computers may include communication devices 116, 118 and 120 used by a technician 110, a customer 112 and a service organization 114 to communicate with one another, such as during the operation of climate control system 104. The service organization may also use a computer 122 for monitoring the operation of climate control system 104, although this computer may be the same as the computer 120 used for communication. And in some examples, the service organization includes a number of units (e.g., offices) responsible for managing such systems.

A number of the computers 116-122 that may be used may be co-located or directly coupled to one another, or in some examples, various ones of the computers may communicate with one another across one or more networks. Further, although shown as part of the system 100, it should be understood that any one or more of the computers may function or operate separately from the system, without regard to any of the other computers. It should also be understood that the system may include one or more additional or alternative computers than those shown in FIG. 1.

Hydronic flow systems may condition facilities and/or area zone units using thermal transport fluid (e.g., water, glycol, refrigerant, etc.) to act as a heat-transfer medium. Hydronic flow systems may include one or more supply loops, configured with a supply line configured to supply the thermal transport fluid from a centralized hydronic facility and a return line configured to return the thermal transport fluid to the centralized hydronic facility. An area zone unit may be fluidically coupled to a respective supply loop such that the thermal transport fluid in the supply line may be provided to the area zone unit, heat transfer may occur, and the thermal transport fluid may be returned to the return line for transport back to the centralized hydronic facility for reconditioning. Typically, the thermal transport fluid may be classified as a supply temperature type based on the temperature of the thermal transport fluid. For example, the thermal transport fluid may be classified as hot, cold, or neutral. The area zone unit may be configured to receive the thermal transport fluid via an area unit supply line, which may provide a heat transfer surface, and draw air and/or blow air across the heat transfer surface to provide conditioning to the environment. As such, depending on the thermal transport fluid supply temperature type provided to the area zone unit, an associated area zone may be heated or cooled. Some area zones may also use one or more hot water coils or cooling coils within the area zone unit to improve heat transfer.

Traditional hydronic flow systems may require each area zone to be configured a user controller (UC) and include two or more area zone units (e.g., a primary area zone unit, a secondary area zone unit, etc.), which are each fluidically coupled to a respective supply loop (e.g., a primary supply loop, a secondary supply loop, etc.). The UC may control condition type requests (e.g., heating or cooling) for the respective area zone to condition the environment associated with the area zone. In order to accomplish this, a particular area zone unit (e.g., fan coils, air handling units, terminal units, etc.) associated with a supply loop flowing the desired thermal transport fluid may actuate to produce the desired conditioning controlled by the UC.

However, since these traditional systems allow for localized control of a condition type request using a UC, adjacent area zones which have conflicting condition type requests (e.g., one area zone has a heating condition type request and an adjacent area zone has a cooling heating condition type request) may allow for simultaneous execution of conflicting conditioning. This is problematic, particularly for adjacent zones that are in an open space or are separated by an uninsulated wall or partition as this results inefficient energy consumption required to maintain the competing environmental conditions. Some facilities may allow this competing behavior due to the misconception that if heat is recovered from the condenser heat from the cooling, this will result in an efficient building. However, this "free" recovered heat alone does not make the climate control system efficient, as a significant artificial cooling and heating load can result from conflict between closely located zones.

Furthermore, since traditional systems typically require separate area zone units for heating and cooling and the space for these area zone units is limited, area zone units used for heating may use heating coils which are much smaller than the cooling coils used in the area zone unit used for cooling. As such, this requires the temperature of the thermal transport fluid to be much higher than necessary to heat the space. For example, the thermal transport fluid used within these traditional systems may require temperatures of around 130 degrees Fahrenheit. This requires a central hydronic plant to produce high temperature thermal transport fluid and the area control unit to expend high amounts of energy to operate a fan, pump, and/or compressor to heat the area zone.

Example implementations of the present disclosure are thus directed to the efficient and improved control of temperature and/or humidity in climate control systems that employ controlled routing of hydronic flow using a distribution area director (DAD).

According to some example implementations, a DAD controller may be configured to control hydronic flow to a number of area zones associated with a DAD, thereby providing for efficient and improved climate control of the area zones. In particular, a climate control system configured with a DAD controller may perform one or more logic operations to route appropriately conditioned thermal transport fluid to an area zone primary units for each area zone unit based on a determined condition type request for the plurality of area zones and a determined supply temperature type associated with at least a supply line of a primary supply loop and a supply line of a secondary supply loop.

The DAD may be configured to control the hydronic flow to a plurality of area zones which share a common area, or common thermal area, for environment conditioning purposes. As such, this prevents adjacent area zones from having conflicting condition type requests and thereby improves energy efficiency of the climate control system.

Furthermore, since the climate control system using the DAD provides the connection to the supply loops, this allows for area zones to operate using only a single area zone unit, if so desired. The area zone unit may use a single area zone unit configured with changeover coils that allow for both heating and cooling. As such, the temperature of the thermal transport fluid may be lowered to allow for more a more efficient centralized hydronic facility. For example, the climate control system using the DAD with a single area zone unit configured with changeover coils may allow for lower thermal transport fluid temperatures of within the range of approximately 90 to 120 degrees Fahrenheit. The use of the changeover coils may also increase the heat pump efficiency of the area zone unit because of the higher temperature drop between the supply line and return line during heating, which allows for a reduction in the temperature of the thermal transport fluid flow. For example, heat pump efficiency may be increased by more than 30% just by using 100 degree Fahrenheit thermal transport fluid instead of 130 degree Fahrenheit thermal transport fluid. By eliminating the need for two separate area zone units, this allows for a more energy efficient and cost efficient climate control system.

Furthermore, the climate control system using the DAD additionally reduces the overall footprint of the hydronic flow system. Since the DAD uses a valve assembly, which is fluidically coupled at least to the supply line of a primary supply loop, a supply line of the secondary supply loop, and a supply line for an area zone unit for each of the plurality of area zones, this allows for a more centralized control of hydronic flow. Since only a single area zone unit is required at each area zone, a climate control system using the DAD may reduce the number of pipes sent to the plurality of zones by half.

Additionally, the DAD is fluidically coupled to at least a primary supply loop and secondary supply loop and is configured to determine a supply temperature type in each loop. As such, the DAD may determine an appropriate actuation signal set for the valve assembly to describe a position for each valve that's based on both the conditioning type request (e.g., heating or cooling) and the determined supply temperatures (e.g., the thermal transport fluid temperatures within a respective supply loop). This allows for proper routing of hydronic flow even in instances when the thermal transport fluid temperature in a respective supply loop change. For example, the supply line temperature in a respective supply loop may change or become neutral (e.g., seasonally or due to usage). In such an instance, the DAD may update the actuation signal set to describe an updated position for each valve based on the new supple temperature types for the supply lines.

The DAD may use a single valve assembly to control the hydronic flow to the area zone units. While valve assemblies could be installed at each area zone, the valve assembly itself may be bulky and still require piping to each valve assembly. For an example, a climate control system configured with a DAD at each area zone of a plurality of area zones, which has 10 area zones and 10 area control units, would require 10 valves assemblies stored in an external space in the wall or ceiling, and may operate at 0.5-2.0 gallons per minute (gpm) each. In contrast a climate control system configured with a single DAD for the plurality of zones requires a single valve assembly which may operate at 5-10 gpm and may be located at a centralized location.

Example Climate Control System

Figure 2:
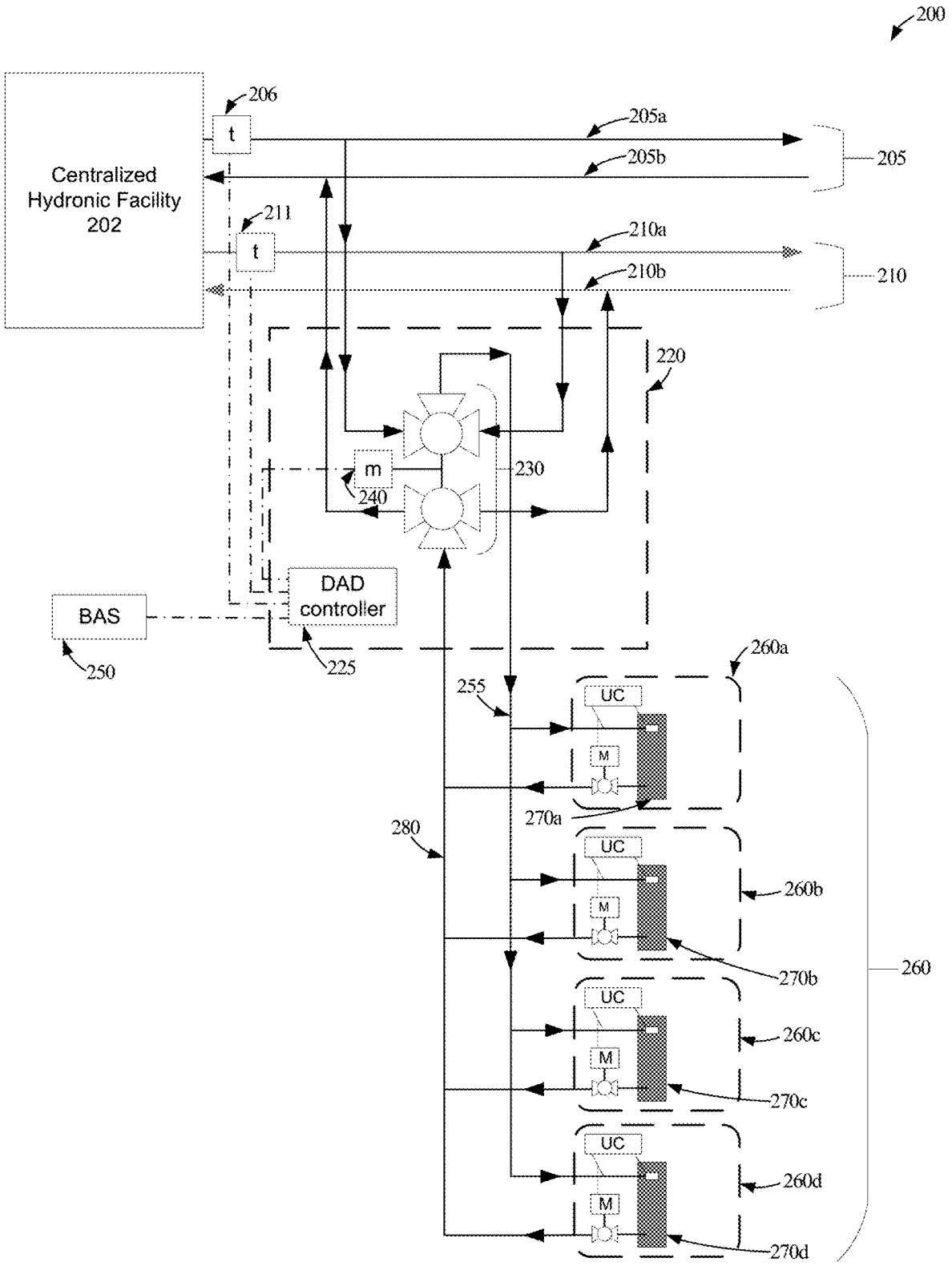

FIG. 2 illustrates certain aspects of a climate control system such as that depicted in FIG. 1, according to some example implementations of the present disclosure. FIG. 2 thus depicts a climate control system 200, which illustrates various example components of a climate control system, such as climate control system 104. The climate control system 200 may be used for controlled routing of hydronic flow. The climate control system 200 includes a primary supply loop 205, a secondary supply loop 210, a DAD 220, a BAS 250, and a plurality of area zones 260.

As illustrated and noted in FIG. 2, the arrows depicted therein indicate the direction of flow of the thermal transport fluid in certain of thermal transport fluid circuits/conduits, which include various of the components noted, including various thermal transport fluid lines, valves, and other hardware. To this end, climate control system 200 includes a number of such transport lines used to transport the thermal transport fluid to and from a DAD 220, a centralized hydronic facility 202, and a plurality of area zone units of the plurality of area zones 260.

It will be noted here that, while the centralized hydronic facility 202 is depicted as a single unit, other embodiments are intended to come within the scope of the present disclosure, as noted earlier herein. For example, rather than a single centralized hydronic facility 202, the primary supply loop 205 and secondary supply loop 210 may be provided with thermal transport fluid from different centralized hydronic facilities and/or may return thermal transport fluid to different centralized hydronic facilities. Additionally, while the plurality of area zones 260 depict four area zones, other embodiments are intended to come within the scope of the present disclosure, as noted earlier herein. For example, any number of area zones may be included within the plurality of area zones.

The centralized hydronic facility 202 may be configured to condition thermal transport fluid to a desired temperature. For example, the centralized hydronic facility 202 may be configured to heat the thermal transport fluid between 90 degrees Fahrenheit to 120 degrees Fahrenheit. The centralized hydronic facility 202 may further be configured to provide a supply line of a supply loop with the conditioned thermal transport fluid.

The primary supply loop 205 may include a supply line 205*a* and a return line 205*b*. In some embodiments, the primary supply loop is configured to supply a cold supply temperature type thermal transport fluid via supply line 205*a*. In some embodiments, the primary supply loop may alternatively be configured to supply a hot supply temperature type thermal transport fluid via supply line 205*a*. The return line 205*b* may be configured to transport thermal transport fluid back to the centralized hydronic facility 202, where the thermal transport fluid may be conditioned as appropriate and resupplied to the primary supply loop 205 or elsewhere. The primary supply loop 205 may provide the DAD 220 with the thermal transport fluid via supply line 205*a* and receive thermal transport fluid from the DAD 220 via return line 205*b*.

Similarly, the secondary supply loop 210 may include a supply line 210*a* and a return line 210*b*. In some embodiments, the secondary supply loop is configured to supply a hot supply temperature type thermal transport fluid via supply line 210*a*. In some embodiments, the secondary supply loop 210 may be smaller than the primary supply loop 205. For example, in some embodiments, the secondary supply loop may be configured to transport one-half or one-third of the thermal transport fluid as the primary supply loop. The smaller dimensions of the secondary supply loop may allow for faster and more energy and cost efficient transport of the hot supply temperature type thermal transport fluid. The return line 210*b* may be configured to transport the thermal transport fluid back to the centralized hydronic facility 202, where the thermal transport fluid may be conditioned as appropriate and resupplied to the secondary supply loop 210 or elsewhere. The secondary supply loop 210 may provide the DAD 220 with the thermal transport fluid via supply line 210*a* and receive thermal transport fluid from the DAD 220 via return line 210*b*.

The DAD 220 may be configured with a valve assembly 230 and a DAD controller 225. The DAD controller 225 may be configured to control the valve assembly 230 in order to control the hydronic flow of the thermal transport fluid. In particular, the DAD controller 225 may provide the actuation signal set to the valve assembly 230. The actuation signal set may be configured to describe a position for each valve of the valve assembly. The DAD controller 225 may be configured to determine a condition type request for the plurality of area zones corresponding to a particular thermal zone 260 as will be described in greater detail in FIGS. 9 and 11. The DAD controller 225 may also be configured to determine a supply temperature type associated with at least the supply line 205*a* of the primary supply loop 205 and the supply line 210*a* of the secondary supply loop 210.

The DAD controller 225 may be in communication with temperature sensors 206 and 211. The temperature sensors 206 and 211 may be located on or in the supply line 205*a* of the primary supply loop 205 and the supply line 210*a* of the secondary supply loop 210, respectively. The temperature sensors 206 and 211 may measure a supply temperature for the corresponding supply line, which may be indicative of a thermal transport fluid temperature within the respective supply line. The DAD controller 225 may receive this supply temperature measurement from the temperature sensors 206 and 211 and may determine a supply temperature type for the supply line 205*a* of the primary supply loop 205 and the supply line 210*a* of the secondary supply loop 210. The determination of the supply temperature type will be discussed in greater detail in FIGS. 9 and 10.

The DAD controller 225 may further be in communication with BAS 250. The BAS 250 may be configured to receive one or more condition type requests from the plurality of area zones 260 amongst other information pertaining to the facility associated with the climate control system 200. The DAD controller 225 may receive the one or more condition type requests and/or other information from the BAS 250.

In some embodiments, the BAS 250 may perform one or more operations on behalf of the DAD controller 225. In some embodiments, the BAS 250 may be configured with a prioritization temperature request model which may be configured to determine a condition type request for the plurality of area zones corresponding to a particular thermal zone 260. The BAS 250 may provide the DAD controller 225 with the results or output from the prioritization temperature request model. Additionally or alternatively, the DAD controller 225 may be configured with the prioritization temperature request model such that the DAD controller 225 may determine the condition type request locally.

In some embodiments, a BAS 250 may not be included in the climate control system. Rather, the DAD controller 225 may be in communication with one or more user controllers associated with area zones 260. In some embodiments, the request may be a binary signal indicative of either a heating or cooling request for the plurality of area zones.

Alternatively, the DAD controller 225 may be in communication with one or more supplemental devices, such as a operator manual switch. The operator manual switch may be slipped into an "on" or "off" position to trigger a signal, which may be a binary signal indicative of a particular temperature type request (e.g., heating, cooling, or off). For example, a manual operator switch in a supply closet on an office floor may trigger a heating temperature type request when in the "on" position and no temperature type request (e.g., off) when in the "off" position.

As depicted in FIG. 2, in some embodiments, the valve assembly 230 is a 6-way valve. In such an embodiment, the valve assembly 230 may be configured with 6 valves. One valve of the valve assembly 230 may be fluidically coupled to the supply line 205*a* of the primary supply loop 205 such that the valve assembly may receive thermal transport fluid from the primary supply loop 205. Another valve of the valve assembly 230 may be fluidically coupled to the supply line 210*a* of the secondary supply loop 210 such that the valve assembly may receive thermal transport fluid from the secondary supply loop 210.

Another valve of the valve assembly 230 may be fluidically coupled to supply line 255 for the area zone primary units such that the area zone primary units 270*a*-270*d* may receive the thermal transport fluid from the valve assembly 230. Another valve of the valve assembly 230 may be fluidically coupled to return line 280 for the area zone primary units such that valve assembly 230 may receive the thermal transport fluid from the area zone primary units 270*a*-270*d*.

Another valve of the valve assembly 230 may be fluidically coupled to the return line 205*b* of the primary supply loop 205 such that the valve assembly may provide the thermal transport fluid to the primary supply loop 205. Another valve of the valve assembly 230 may be fluidically coupled to the return line 210*b* of the secondary supply loop 210 such that the valve assembly may provide the thermal transport fluid to the secondary supply loop 210.

The valve assembly may be configured with one or more valves, which may be used to control the flow of thermal transport fluid throughout the climate control system 200. In particular, each valve of the valve assembly may have a valve position, which may be used to control the flow of the thermal transport fluid. For example, one or more sources of the thermal transport fluid may be possible and the position of a valve (e.g., opened or closed) fluidically coupled to a source may control whether or not thermal transport fluid from the particular source is used.

The valve position may be actuated and/or controlled by the DAD controller 225. A valve position may include an open position or closed position. In an open position, the respective valve may allow the thermal transport fluid to flow through the valve whereas a closed position may prevent the thermal transport fluid from flowing through the valve.

As mentioned above, the position of each valve of the valve assembly may control the flow of thermal transport fluid to and from the valve assembly 230 and the position of each valve may be described by the actuation signal set. In some embodiments, the valve assembly set may be associated with a particular combination of valve positions and may further be associated with a thermal transport fluid source.

For example, a "primary" actuation signal set may indicate that the primary supply loop 205 is supplying the thermal transport fluid to the plurality of area zones 260. The "primary" actuation signal set may thus indicate a valve position of open for the valves fluidically coupled to the supply line 205*a* of the primary supply loop 205, the return line 205*b* of the primary supply loop 205, the supply line 255 for the area zone primary units 270*a*-270*d*, and the return line 280 for the area zone primary units 270*a*-270*d*. The "primary" actuation signal set may further indicate a valve position of closed for the valves fluidically coupled to the supply line 210*a* of the secondary supply loop 210 and the return line 210*b* of the secondary supply loop 210.

As another example, a "secondary" actuation signal set may indicate that the secondary supply loop 210 is supplying the thermal transport fluid to the plurality of area zones 260. The "secondary" actuation signal set may thus indicate a valve position of open for the valves fluidically coupled to the supply line 210*a* of the secondary supply loop 210, the return line 210*b* of the secondary supply loop 210, the supply line 255 for the area zone primary units 270*a*-270*d*, and the return line 280 for the area zone primary units 270*a*-270*d*. The "secondary" actuation signal set may further indicate a valve position of closed for the valves fluidically coupled to the supply line 205*a* of the primary supply loop 205 and the return line 205*b* of the primary supply loop 205.

As another example, a "closed" actuation signal set may indicate that there should be no thermal transport fluid to the plurality of area zones 260. The "closed" actuation signal set may thus indicate a valve position of closed for the valves fluidically coupled to at least the supply line 205*a* of the primary supply loop 205 and the supply line 210*a* of the secondary supply loop 210. The valve position may be either closed or open for the return line 205*b* of the primary supply loop 205, the return line 210*b* of the secondary supply loop 210, the supply line 255 for the area zone primary units 270*a*-270*d*, and the return line 280 for the area zone primary units 270*a*-270*d*.

The actuation signal set that is selected and/or determined by the DAD controller 225 may be based on the supply temperature type associated with the supply line 205*a* of the primary supply loop 205, the supply temperature type associated with the supply line 210*a* of the secondary supply loop 210, and the condition type request. For example, if a cold supply temperature type is associated with the supply line 205*a* of the primary supply loop 205, a hot supply temperature type is the supply line 210*a* of the secondary supply loop 210, and a heating condition type request, the DAD controller 225 may determine to use a "secondary" actuation signal set. As such, the heated thermal transport fluid within the supply line 210*a* of the secondary supply loop 210 may be provided to the plurality of area zones 260 such that the area zones are properly conditioned.

FIG. 14 depicts an operational example of the different types of actuation signal sets 1400 determined by the DAD controller 225 given various combinations of the determining factors. As described above, an actuation signal set 1404 may be selected based on the supply temperature type of the primary supply loop 1401, the supply temperature type of the secondary supply loop 1402, and the condition type request for the plurality of area zones 1403. For example, DAD controller in a climate control system configured with a cold supply temperature type in the primary supply loop, a hot supply temperature type in the secondary supply loop, and a heating condition type request may select or otherwise determine to use a secondary actuation signal set.

In some embodiments, the valve assembly may also include a metering device 240, which may regulate the rate at which the thermal transport fluid ultimately flows into or out of the valve assembly 230. The metering device 240 may be in communication with the DAD controller 225 such that the DAD controller may receive measurements, values, or information from the metering device 240 An example of a metering device 240 is a pressure independent control (PIC) valve. The PIC valve may meter the flow of thermal transport fluid, such as by using a differential pressure regulator.

In some embodiments, a valve configured for an open valve position by the DAD controller 225 may control the portion by which the valve is open. That is, a valve of the valve assembly may be configured to allow on a portion of the thermal transport fluid through the valve. For example, a valve position may describe that the corresponding valve is to be 60% open, such that the valve only allows 60% of the total potential thermal transport fluid through the valve. As another example, a valve position may describe the corresponding valve is to be open and allow a flow of 5 gpm. The DAD controller 225 may use the metering device 240 to adjust the valve position accordingly. As such, the valve may have improved control over the flow of the rate or other characteristics by which the thermal transport fluid is supplied by the valve assembly 230.

As depicted in FIG. 2, the plurality of area zones 260 may include individual area zones 260*a*-260*d*. Each area zone 260*a*-260*d* may be configured with at least an area zone primary unit 270*a*-270*d*. In some embodiments, the area zone primary unit 270*a*-270*d* is a fan coil, air handling unit, or a terminal unit. The area zone primary unit 270*a*-270*d* for one area zone 260*a*-260*d* may be different than the area zone primary units 270*a*-270*d* associated with other area zones 260*a*-260*d*. As mentioned above, the area zone primary units 270*a*-270*d* may be configured with one or more changeover coils, which may be used to provide conditioned air to the corresponding area zone. In some embodiments, the area zone primary units 270*a*-270*d* may include 4, 6, or 8 row changeover coils.

The type of conditioning provided to the area zone is dependent upon the supply temperature type of the thermal transport fluid supplied to the area zone primary units 270*a*-270*d*. For example, if the supply temperature type of the thermal transport fluid supplied to the area zone primary units 270*a*-270*d* is a hot supply temperature type, the area zones 260*a*-260*d* may be provided with heating. As another example, if the supply temperature type of the thermal transport fluid supplied to the area zone primary units 270*a*-270*d* is a cold supply temperature type, the area zones 260*a*-260*d* may be provided with cooling.

Each area zone primary unit 270*a*-270*d* may be in communication with a UC, which may receive occupant condition type requests. In some embodiments, a condition type request is defined by a set point temperature as input by an occupant. In some embodiments, each UC may be in communication with the DAD controller 225 and/or the BAS 250. As such, the UC may provide and/or transmit received condition type requests to a DAD controller 225 and/or BAS 250. In some embodiments, the BAS 250 may provide the DAD controller 225 with the received condition type requests.

Each area zone primary unit 260*a-d* may be fluidically coupled to the valve assembly 230 via a supply line 255 and return line 280. In some embodiments, the area zone primary unit may also include a metering device, similar to the metering device used with the valve assembly 230, which may regulate the rate at which the thermal transport fluid ultimately flows into the area zone primary unit 270*a-d* from the supply line 255 and/or out of the area zone primary unit 270*a-d* into the return line 270. An example of a metering device is a pressure independent control (PIC) valve. The PIC valve may meter the flow of thermal transport fluid, such as by using a differential pressure regulator.

Figure 3:
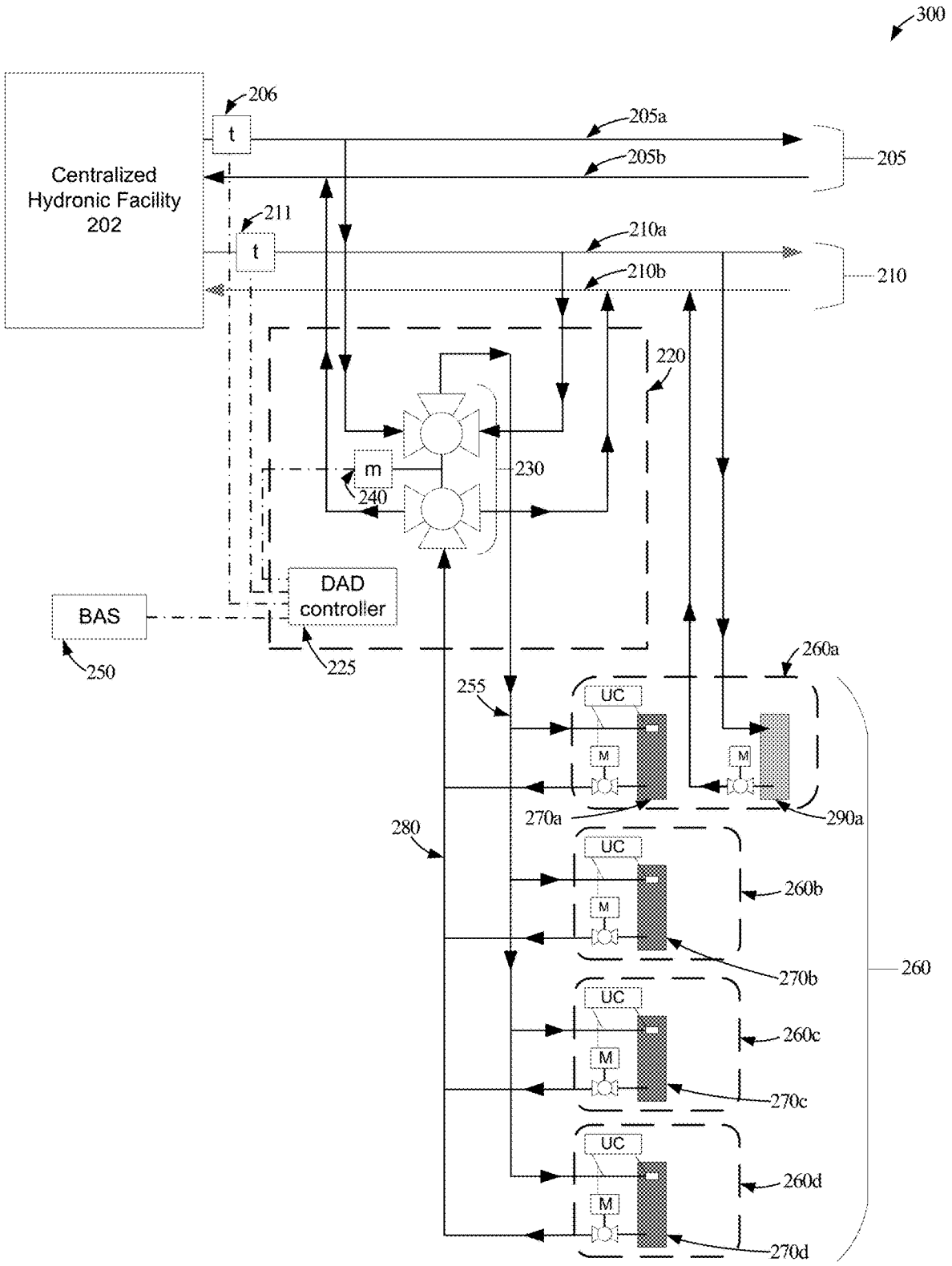

FIG. 3 is another example of a climate control system configuration, and depicts another climate control system 300 which is similarly configured as the climate control system 200. In the climate control system 300, one or more of the plurality of area zones 260 may include one or more auxiliary area zone units 290*a*. The one or more auxiliary area zone units 290*a* may be fluidically coupled to a supply line 210*a* via a secondary supply line and return line 210*b* via a secondary return line of the secondary supply loop 210. Alternatively, the one or more auxiliary area zone units 290*a* may be fluidically coupled to supply line 205*a* and return line 205*b* of the primary supply loop 205. In some embodiments, the one or more auxiliary area zone units 290*a* is a fan coil, air handling unit, or a terminal unit.

For example, as shown in FIG. 3, area zone 260*a* includes an auxiliary area zone unit 290*a*. The supply line 210*a* of the secondary supply loop 210 may be configured to provide a hot supply condition type thermal transport fluid. In some embodiments, the auxiliary area zone units 290*a* may be one or more reheat coils. As such, the one or more auxiliary area zone units 290*a*, which may be fluidically coupled to supply line 210*a* and return line 210*b* of the supply loop 210, may act as a dehumidification system to further condition the air for moisture in addition to conditioning for temperature by the primary area zone units 270*a*-270*d*.

Figure 4:
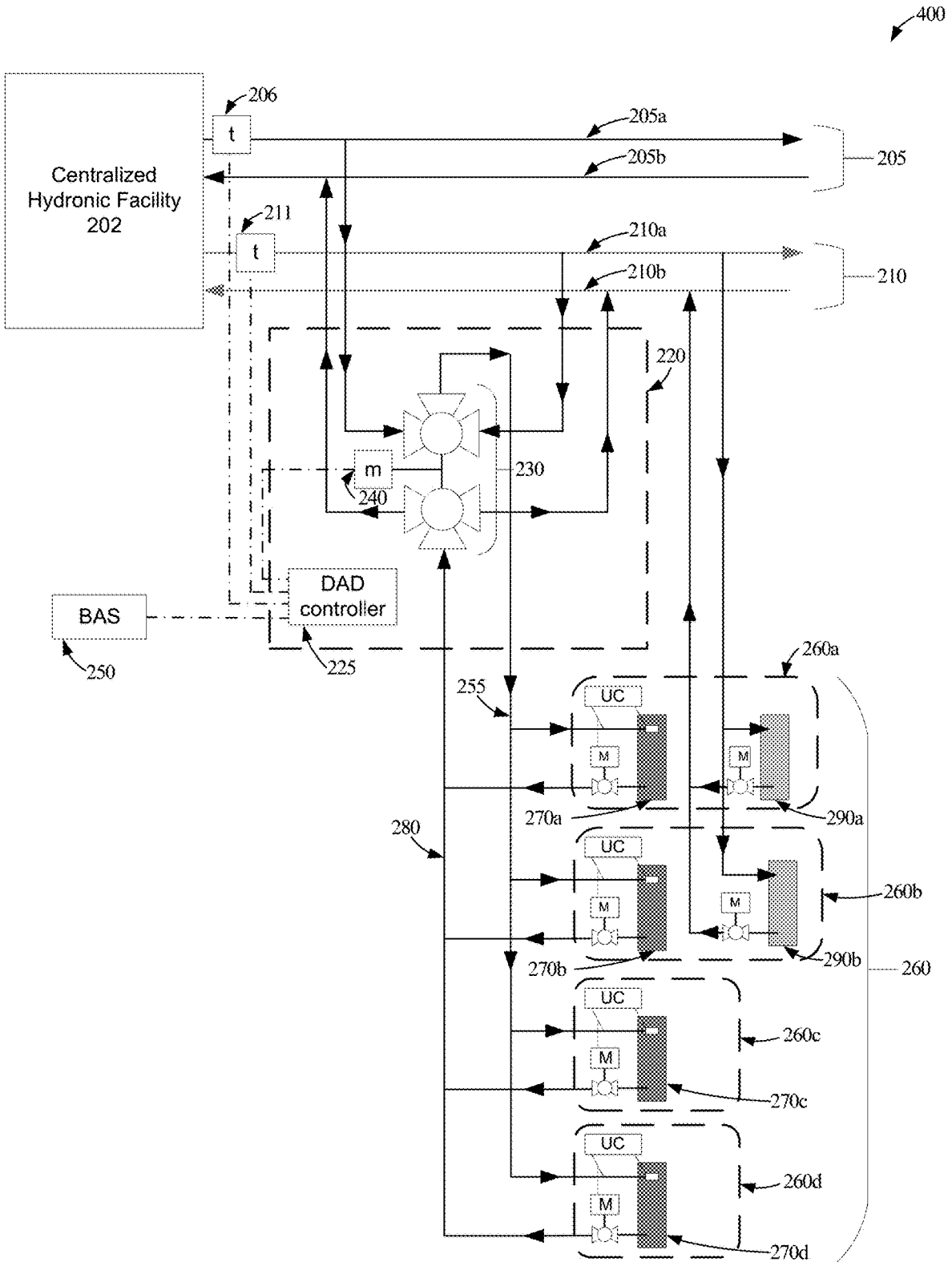

FIG. 4 is another example of a climate control system configuration, and depicts another climate control system 400 which is similarly configured as the climate control systems 200 and 300. The climate control system 400 may include another area zone 260*b* which is also configured with an auxiliary area zone unit 290*b*. The auxiliary area zone units 290*a* and 290*b* may provide additional heat to the area zones 260*a* and 260*b*, respectively, which may be high heat load area zones.

The supply line 210*a* of the secondary supply loop 210 may again be configured to provide a hot supply condition type thermal transport fluid. In climate control system 300, area zone 260*b* is additionally configured with an auxiliary area zone unit 290*b*. The auxiliary area zone unit 270*a-c* may be fluidically coupled to the supply line 210*a* and return line 210*b* of the secondary supply loop 210. In some embodiments, one or more of the plurality of area zones 260 may be a high heat load area zone and/or a critical area zone. For example, area zone 260*b* may be a high heat load area such that supplemental heating may be needed in addition to the heating provided by primary area zone unit 270*b*. As such, the auxiliary area zone unit 290*b* may supply area zone 260*b* with an increased heat load, thereby achieving a desired setpoint temperature for the area zone 260*b*.

Figure 5:
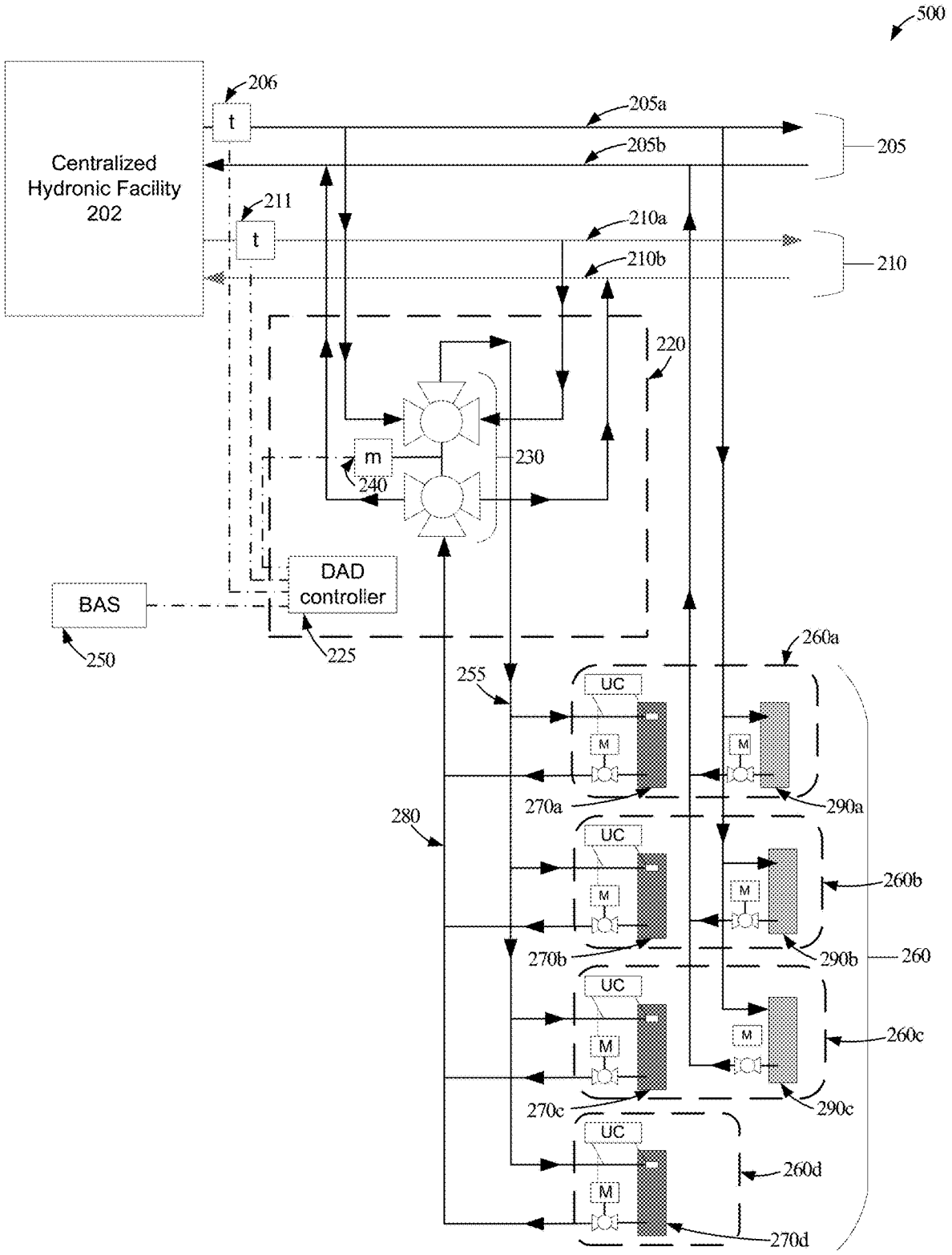

As another example climate control system configuration, FIG. 5 depicts another climate control system 500 which is similarly configured as the climate control systems 200 to 400. The climate control system 500 may include another area zone 260*c* which is also configured with an auxiliary area zone unit 290*c*. The auxiliary area zone units 290*a*-290*c* may be fluidically coupled to the primary supply loop 205 and may therefore provide additional cooling to the area zones 260*a*-260*c*, respectively.

The supply line 205*a* of the primary supply loop 205 may be configured to provide a cold supply condition type thermal transport fluid. In climate control system 400, area zones 260*a-c* are additionally configured with an auxiliary area zone units 290*a*-290*c*. In some embodiments, one or more auxiliary units 290*a*-290*c* may be fan coils, air handling units, and terminal units and include one or more preheat coils and/or cooling coils. The auxiliary area zone units 290*a*-290*c* may be fluidically coupled to the supply line 205*a* and return line 205*b* of the primary supply loop 205. As such, the auxiliary area zone units 290*a*-290*c* may supply the area zones 260*a*-260*c* with additional cooling, thereby achieving a desired setpoint temperature for the area zone 260*a*-260*c*.

Figure 6:
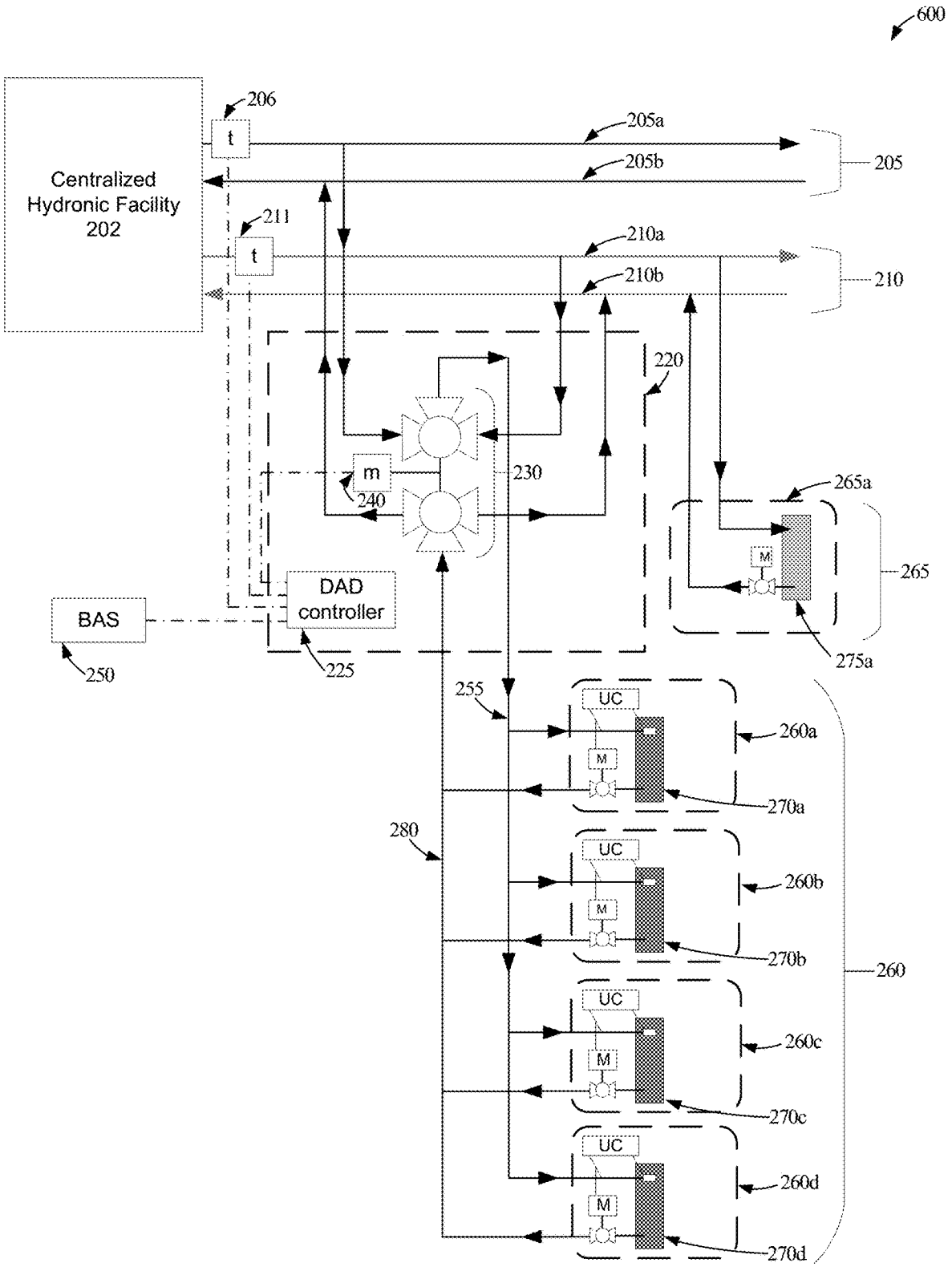

As another example climate control system configuration, FIG. 6 depicts another climate control system 600 which is similarly configured as the climate control systems 200 to 500. The climate control system 600 may include area zone 260*a*-260*d*, which are each conditioned by the DAD 220 to provide heating and cooling. The climate control system 600 may also include an additional area zone 265, which may operate independently of the DAD 220. The additional area zone 265 may be a minimally conditioned zone requiring only seasonal heating or cooling.

The supply line 210*a* of the secondary supply loop 210 may be configured to provide a hot supply condition type thermal transport fluid. In climate control system 500, one or more additional area zones 265 may be included within the climate control system 600. Each additional area zone 265 may be configured with an additional primary area zone unit 275*a*, similar to the primary area zone units 270*a*-270*d* associated with the plurality of area zones associated with the DAD 220. The additional primary area zone unit 275*a* may be fluidically coupled to the supply line 210*a* via a secondary supply line and return line 210*b* via a secondary supply line of the secondary supply loop. The additional area zone 265 may be a minimally condition zone. For example, the additional area zone 265 may be a stairwell, entryway, etc. which requires only heating during winter months.

Figure 7:
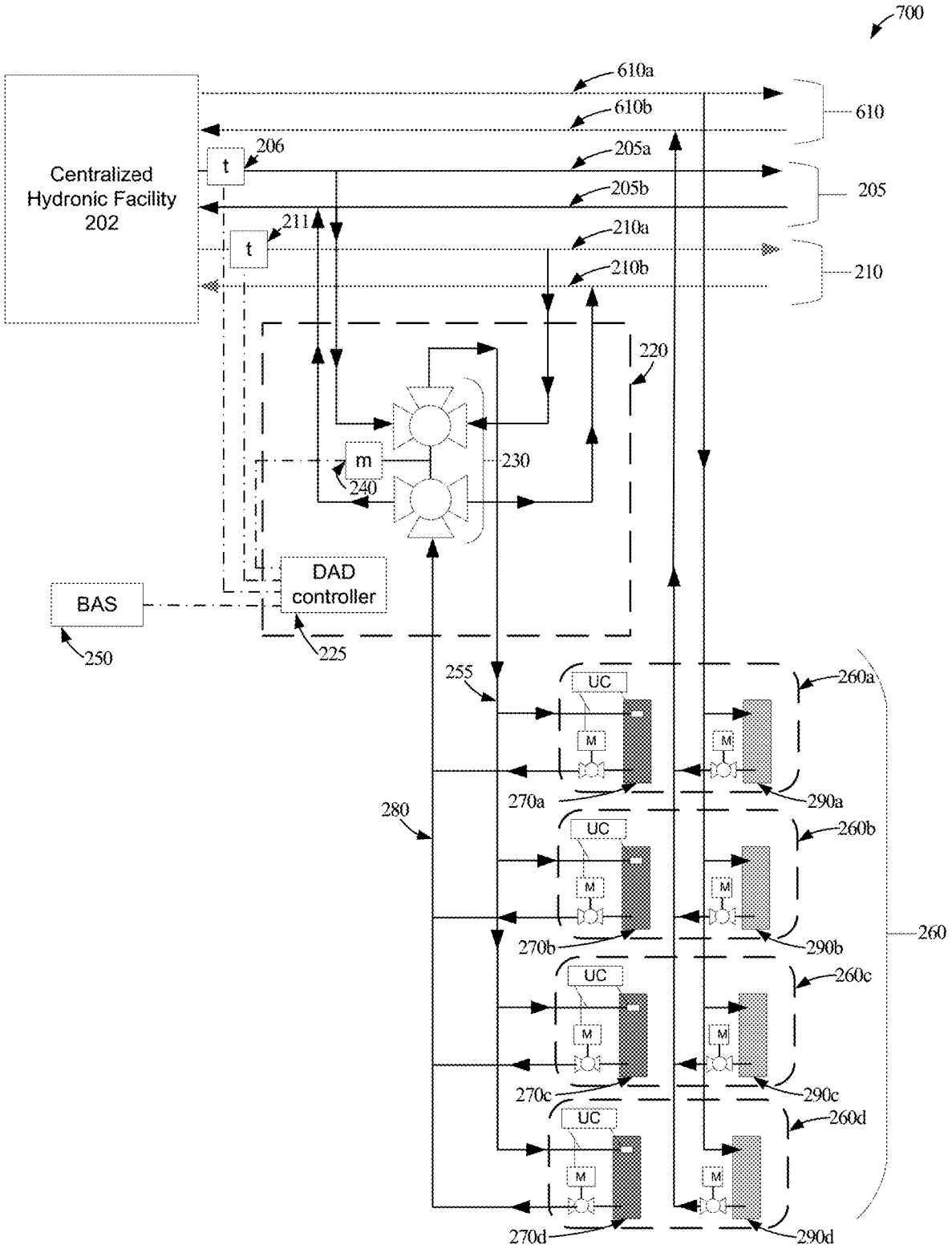

As another example climate control system configuration, FIG. 7 depicts another climate control system 700 which is similarly configured as the climate control systems 200 to 600. The climate control system 700 may include an auxiliary supply loop 610. The auxiliary supply loop 610 may provide a resiliency measure to ensure the area zones

260*a*-260*d*, each configured with an auxiliary area zone unit 290*a*-290*d*, respectively, are able to maintain a temperature which satisfies a threshold temperature value. For example, a threshold temperature value may be 64 degrees Fahrenheit. In the event the secondary supply loop 210 fails to provide hot thermal supply fluid (e.g., the thermal supply fluid is not properly conditioned), the auxiliary area zone units 290*a*-290*d* may be fluidically coupled to auxiliary supply loop 610, which is also configured to supply hot thermal supply fluid supplied. As such, the area zones 610*a*-610*d* may still be provided with heat using the auxiliary area zone units 290*a*-290*b* which are fluidically connected to the auxiliary supply loop 610.

The climate control system 700 further includes an auxiliary supply loop 610. The auxiliary supply loop 610 may include a supply line 610*a* and a return line 610*b*. In some embodiments, the auxiliary supply loop 610 is configured to supply a hot supply temperature type thermal transport fluid via supply line 610*a*. In some embodiments, the temperature of the thermal transport fluid in the auxiliary supply loop 610 may be higher than the temperature of the thermal transport fluid in the primary supply loop 205 and/or secondary supply loop 210. The return line 610*b* may be configured to transport thermal transport fluid back to the centralized hydronic facility 202, where the thermal transport fluid may be conditioned as appropriate and resupplied to the auxiliary supply loop 610 or elsewhere. The supply line 610*a* may provide the DAD 220 with the thermal transport fluid via supply line 610*a* and receive thermal transport fluid from the DAD 220 via return line 610*b*.

The auxiliary supply loop 610 may be used as back-up hot supply temperature type thermal transport fluid, thereby providing a resiliency measure in an instance the hot supply temperature type thermal transport fluid supplied by one or more of the primary supply loop 205 and/or secondary supply loop 210 fails. As such, in some embodiments, the auxiliary area zone units 290*a*-290*d* may be used only in an instance the primary supply loop 205 and/or secondary supply loop 210 fails to supply the appropriately conditioned thermal transport fluid. As such, the plurality of area zones 260 may still be conditioned in accordance with an associated condition type request.

Figure 8:
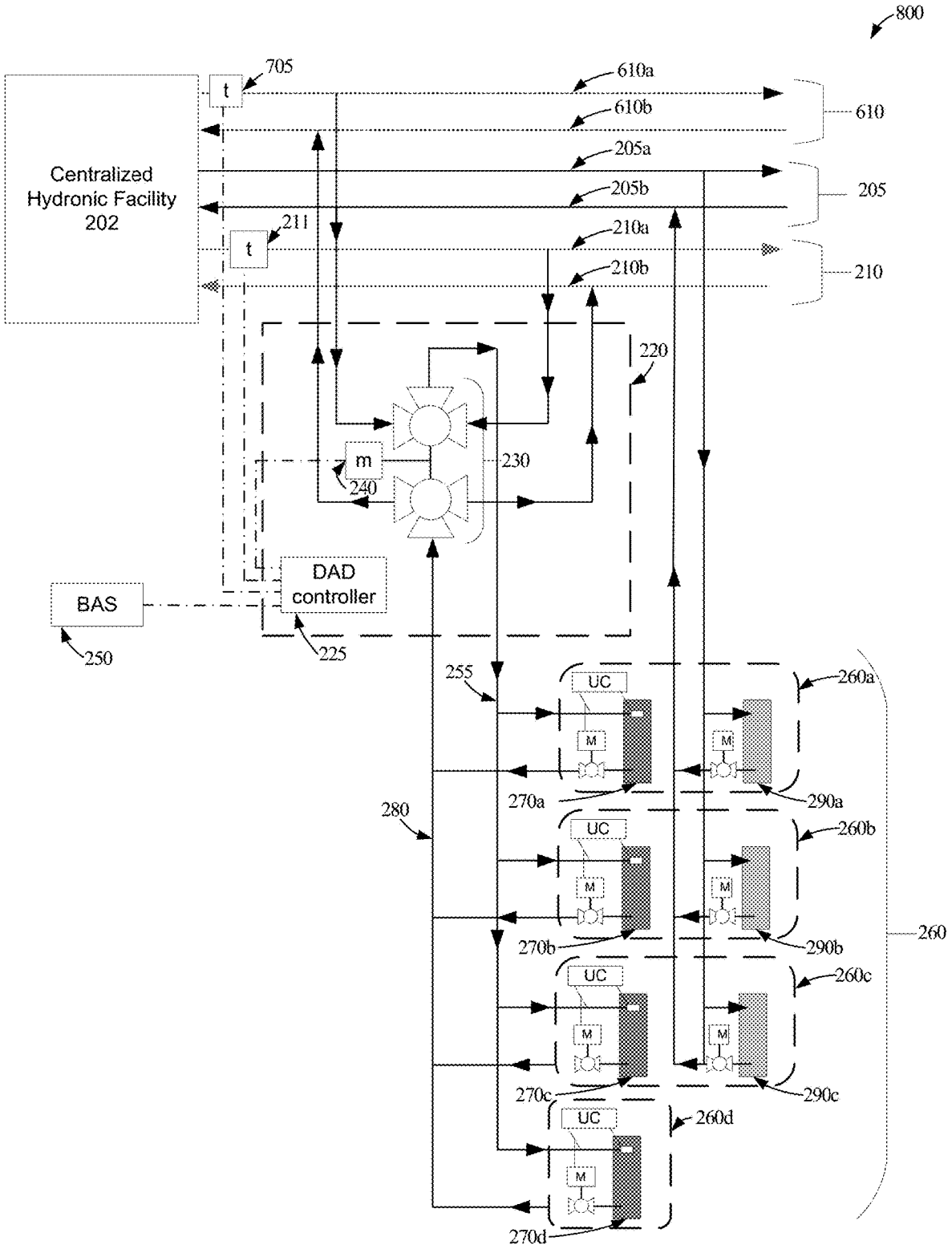

FIG. 8 depicts another climate control system 800 which is similarly configured as the climate control systems 200 to 700. The climate control system 800 may include an auxiliary supply loop 610, which may be fluidically connected to the valve assembly 230. The auxiliary supply loop 610 may provide a resiliency measure to ensure the primary area zone units 270*a*-270*d* are provided with properly conditioned thermal supply fluid. For example, secondary supply loop 210 and auxiliary supply loop 610 may both provide hot thermal supply fluid and be fluidically coupled to the valve assembly 230. As such, if either secondary supply loop 210 or auxiliary supply loop 610 fail to provide hot thermal supply fluid, the DAD controller 225 may still route hot thermal supply fluid to the primary area zone units 260*a*-260*d* using the other supply loop.

The climate control system 800 includes an auxiliary supply loop 610 as described above in accordance with FIG. 7. As depicted in FIG. 8, the valve assembly 230 may be fluidically coupled to the auxiliary supply loop 610 and the secondary supply loop 210. As described above, the valve assembly 230 may be a 6-way valve. In the climate control system 800 depicted in FIG. 8, the 6 valves of valve assembly 230 may be configured such that the fluidic connections between the valve assembly 230 and the primary supply loop 205 is replaced with fluidic connections between the valve assembly 230 and the auxiliary supply loop 290. In particular, one valve of the valve assembly 230 may be fluidically coupled to the supply line 610*a* of the auxiliary supply loop 610 such that the valve assembly may receive thermal transport fluid from the auxiliary supply loop 610. Another valve of the valve assembly 230 may be fluidically coupled to the return line 610*b* of the auxiliary supply loop 610 such that the valve assembly 230 may provide the thermal transport fluid back to the auxiliary supply loop 610. The DAD controller 225 may also be in communication with a temperature sensor 705, which may be located on or in the supply line 610*a* of the auxiliary supply loop 610. The temperature sensor 705 may measure a supply temperature for the supply line 610*a*, which may be indicative of a thermal transport fluid temperature within supply line 610*a* of the auxiliary supply loop 610.

In some embodiments, the primary area zone units 270*a*-270*d* may provide heating to the plurality of area zones 260. If the area zones 260*a*-260*d* require cooling conditioning as well, the respective area zone may include an auxiliary area zone unit 290*a*-290*c*. The auxiliary area zone units 290*a*-290*c* may be fluidically connected to the supply line 205*a* of the primary supply loop 205 and the return line 205*b* of the primary supply loop 205. As such, the auxiliary area zone units 290*a*-290*c* may be configured to provide cooling to the corresponding area zones 260*a*-260*c*.

Figure 9:
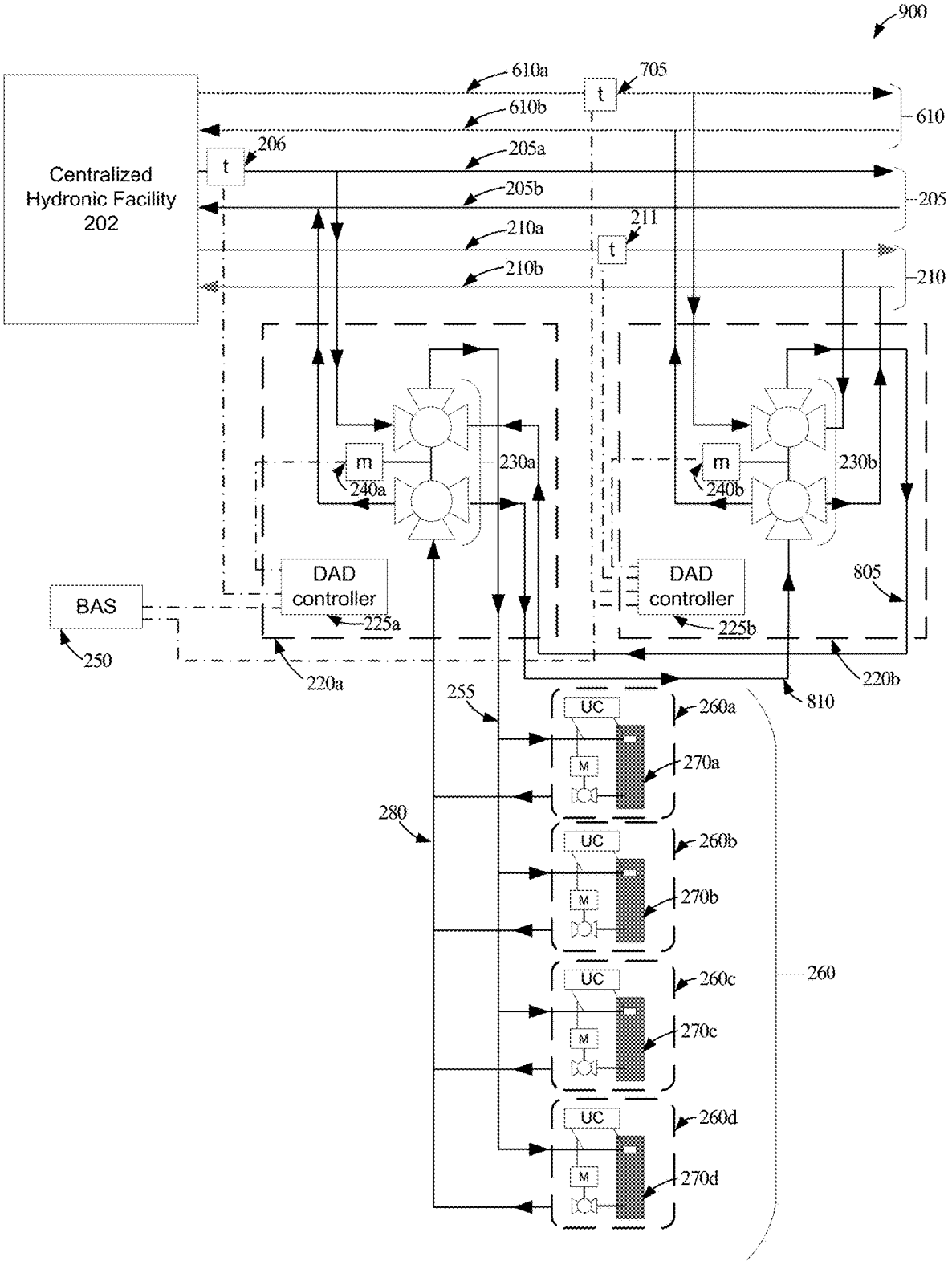

As yet another example climate control system configuration, FIG. 9 depicts another climate control system 900 which is similarly configured as the climate control systems 200 to 800. The climate control system 900 may include an auxiliary supply loop 610, which may be fluidically connected to the valve assembly 230*a*-230*b*. The valve assembly 230*a*-230*b* may also be fluidically coupled to the primary supply loop 205 and the secondary supply loop 210. As such, the configuration depicted in FIG. 9 may also benefit from the added resiliency of having auxiliary supply loop 610 while still maintaining the fluidic connections to the primary supply loop 205 and secondary supply loop 210.

The climate control system 900 includes an auxiliary supply loop 610 as described above in accordance with FIGS. 7-8. As depicted in FIG. 9, the DAD 220 may include two or more sub-DAD units, such as first sub-DAD unit 220*a* and second sub-DAD unit 220*b*. Each sub-DAD unit 220*a*-220*b* may include a respective sub-DAD controller 225*a* and 225*b*, respectively, which may each be communication with the BAS 250 and in some embodiments, with each other.

The first DAD controller 225*a* may be communicatively coupled to temperature sensors 206*a* corresponding to the primary supply loop 205. The second DAD controller 225*b* may be communicatively coupled to temperature sensor 705 of the auxiliary supply loop 610 and temperature sensor 211 of the secondary supply loop 210.

Each sub-DAD unit 220*a*-220*b* may include a respective six way valve such that the valve assembly 230 includes two or more six-way valves. In particular, the valve assembly 230 may include a first 6 way valve 230*a* and a second 6 way valve 230*b*. The two or more six way valves 230*a*-230*b* may be fluidically coupled to the primary supply loop 205, the secondary supply loop 210, the auxiliary supply loop 610, and the plurality of primary area zone units 270*a*-270*d*.

The second valve assembly 230*b* may be configured as follows. One valve may be fluidically coupled to the supply line 610*a* of the auxiliary supply loop 610 such that the second valve assembly 230*b* may receive thermal transport fluid from the auxiliary supply loop 610. Another valve of the second valve assembly 230*b* may be fluidically coupled to the supply line 210*a* of the secondary supply loop 210 such that the valve assembly may receive thermal transport fluid from the secondary supply loop 210.

Another valve of the second valve assembly 230*b* may be fluidically coupled to supply line 805 for the first valve assembly 230*a* such that the first valve assembly 230*a* may receive the thermal transport fluid from the second valve assembly 230*b*. Another valve of the second valve assembly 230*b* may be fluidically coupled to return line 810 for the first valve assembly 230*a* such that second valve assembly 230*b* may receive the thermal transport fluid from the first valve assembly 230*a*.

Another valve of the second valve assembly 230*b* may be fluidically coupled to the return line 610*b* of the auxiliary supply loop 610 such that the second valve assembly 230*b* may provide the thermal transport fluid to the auxiliary supply loop 610. Another valve of the second valve assembly 230*b* may be fluidically coupled to the return line 210*b* of the secondary supply loop 210 such that the second valve assembly 230*b* may provide the thermal transport fluid to the secondary supply loop 210.

The first valve assembly 230*a* may be configured as follows. One valve of the first valve assembly 230*a* may be fluidically coupled to the supply line 205*a* of the primary supply loop 205 such that the first valve assembly 230*a* may receive thermal transport fluid from the primary supply loop 205. Another valve of the first valve assembly 230*b* may be fluidically coupled to supply line 805 for the second valve assembly 230*b* such that the first valve assembly 230*a* may receive the thermal transport fluid from the second valve assembly 230*b*.

Another valve of the first valve assembly 230*a* may be fluidically coupled to return line 810 for the second valve assembly 230*b* such that first valve assembly 230*a* may provide the thermal transport fluid to the second valve assembly 230*b*.

Another valve of the first valve assembly 230*a* may be fluidically coupled to supply line 255 for the area zone primary units 270*a*-270*d* such that the area zone primary units 270*a*-270*d* may receive the thermal transport fluid from the first valve assembly 230*a*. Another valve of the first valve assembly 230*a* may be fluidically coupled to return line 280 for the area zone primary units 270*a*-270*d* such that first valve assembly 230*a* may receive the thermal transport fluid from the area zone primary units 270*a*-270*d*.

Another valve of the first valve assembly 230*a* may be fluidically coupled to the return line 205*b* of the primary supply loop 205 such that the first valve assembly 230*a* may provide the thermal transport fluid to the primary supply loop 205.

The climate control system 900 may use the more complex DAD configuration to allow for increased options for hydronic flow routing. In this configuration, the DAD controllers 225*a* and 225*b* may perform additional evaluation to determine the more efficient routing of thermal transport fluid as supplied by the primary supply loop 205, secondary supply loop 210, and/or auxiliary supply loop 610. For example, as detailed above, the inclusion of an auxiliary supply loop 610 may allow for the provision of a hot supply temperature type thermal transport fluid in even in an instance where the secondary supply loop 210 fails to provide hot supply temperature type thermal transport fluid. Furthermore, the DAD controllers 225*a* and 225*b* may be with provided with increased options for thermal transport fluid selection such that the selected supply may be more energy efficient. For example, if the plurality of area zones 260 are all high heat load zones for at least a portion of time, it may be beneficial to provide a connection to the auxiliary supply loop 610 as the thermal transport fluid may be hotter than the thermal transport fluid supplied by secondary supply loop 210 while still allowing for lower heat loads via the connection to the secondary supply loop 210 and primary supply loop 205.

Figure 10:
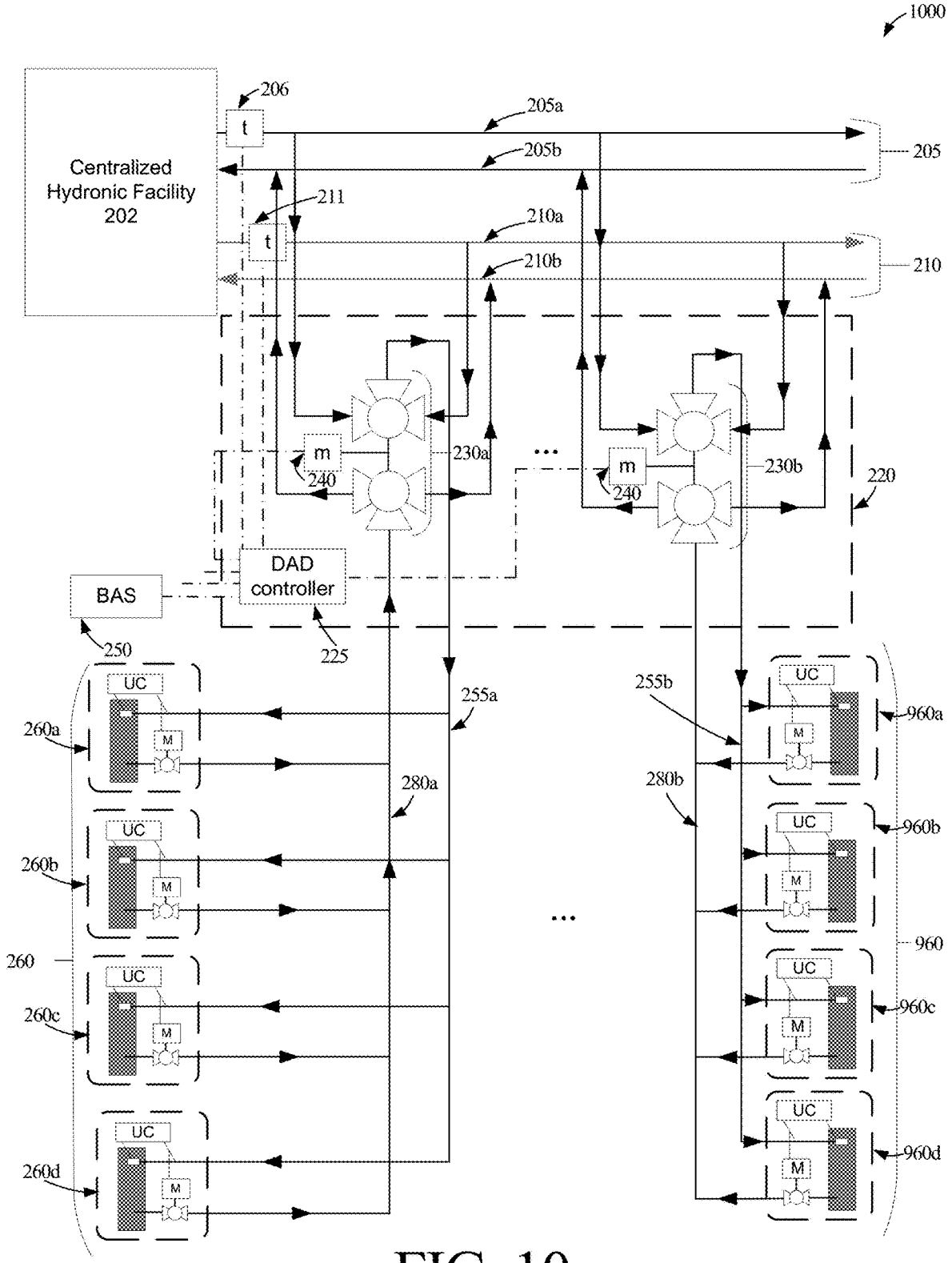

As yet another example climate control system configuration, FIG. 10 depicts another climate control system 1000 which is similarly configured as the climate control systems 200 to 900. As depicted in FIG. 10, in some embodiments, the DAD 220 may control the routing of hydronic flow for two or more thermal zones, where each thermal zone includes a plurality of area zones. For example, as depicted in FIG. 10, a first plurality of area zones 260 may include area zones 260*a*-260*d* which are in a first thermal zone and a nth plurality of area zones 960 may include area zones 960*a*-960*d* which are in an nth thermal zone. The DAD controller 225 of the DAD 220 may route hydronic flow for each connected thermal zone. It will be appreciated by one of skill in the art that although only two six-way valves and thermal zones are depicted in FIG. 10, any number of six-way valves and thermal zones may be contemplated.

The valve assembly of climate control system 1000 may include two or more six-way valves 230*a*-230*b*. One or more six way valves may be fluidically coupled to a particular plurality of area zones for a particular thermal zone. For example, the six-way valve 230*a* may route hydronic flow to the plurality of area zones 260 corresponding to the first thermal zone while six-way valve 230*b* may route hydronic flow to the plurality of area zones 960 corresponding to the nth thermal zone. Each thermal zone may provide condition type request to the DAD controller 225. The DAD controller 225 may then process each condition type request and provide an actuation signal set to one or more six-way valves which correspond to the particular thermal zone. As such, a single DAD controller 225 may handle condition type requests for two or more thermal zones using the valve assembly.

In the manner noted, embodiments such as those described herein are able to provide for a controlled routing of hydronic flow. The climate control system may use a DAD controller to perform various operations to determine the appropriate routing of hydronic flow based on a variety of factors, such as the conditioning type request and a determined supply temperature type for supply lines of a primary supply loop, secondary supply loop, and/or auxiliary supply loop. Using techniques such as those described herein, a climate control system may use a DAD to more efficiently and effectively route thermal transport fluid to primary area zone units for conditioning of the corresponding are zone, resulting in improved energy efficiency, cost savings, and increased conditioning options.

Functionality such as that described above will be discussed in connection with FIGS. 11-13.

Example DAD Operations

FIG. 11 is a flowchart illustrating various example operations of a method for controlling the routing of hydronic flow within a climate control system. FIG. 11 thus depicts a routing hydronic flow process 1100. As will be appreciated, the operations depicted in the routing hydronic flow process 1100 are merely examples of the operations relevant to the discussion herein, and as noted, other sensor inputs will be received by a system control unit such as DAD controller 225, which may be embodied as the apparatus 1500, which will then perform operations relevant to those sensor inputs, and control various components within climate control system 200 as appropriate.

The routing hydronic flow process begins at operation 1102, where apparatus 1500 may be configured to determine a condition type request for a plurality of area zones, such are area zones 260*a*-260*d*. In some embodiments, the condition type request may be a cooling request or heating request. The condition type request may be a request for conditioning of each area zone of the plurality of zones which are associated with a DAD 220. In some embodiments, the apparatus 1500 may be configured to receive the condition type request from an external computing device, such as BAS 250. Alternatively, the apparatus 1500 may be configured to determine the condition type request locally. The determination of a condition type request may be described in further detail in FIG. 13.

At operation 1104, the apparatus 1500 may determine a supply temperature type associated with one or more supply lines. In some embodiments, the apparatus 1500 may determine a supply temperature type associated with a supply line of a primary supply loop 205, a secondary supply loop 210, and/or an auxiliary supply loop 610 as described above in one or more of FIGS. 2-8. The supply temperature type may be indicative of a thermal transport fluid temperature within the respective supply line The particular supply temperature type may be determined for the supply lines to which the valve assembly of the DAD is fluidically coupled with. In some embodiments, the supply temperature type includes a hot supply temperature type, neutral supply temperature type, and cold supply temperature type. In some embodiments, the apparatus may be configured to determine a supply temperature type associated with at least a supply line 205*a* of a primary supply loop 205 and a supply line 210*a* of a secondary supply loop 210. The determination of a supply temperature type may be described in further detail in FIG. 12.

At operation 1106, the apparatus 1300 may provide an actuation signal set to a valve assembly, such as valve assembly 230. As described above, the actuation signal set may be configured to describe a position for each valve of the valve assembly. Furthermore, the determination of the actuation signal set and the position of each valve may be based on the conditioning type request.

The actuation signal set that is selected and/or determined may be based on the supply temperature type associated with the supply line 205*a* of the primary supply loop 205, the supply temperature type associated with the supply line 210*a* of the secondary supply loop 210, the supply temperature type associated with an auxiliary supply loop 610 (if applicable), and the condition type request. For example, for the climate control system 200 depicted in FIG. 2, if a cold supply temperature type is associated with the supply line 205*a* of the primary supply loop 205, a hot supply temperature type is the supply line 210*a* of the secondary supply loop 210, and a heating condition type request, the DAD controller 225 may determine to use a "secondary" actuation signal set. As such, the heated thermal transport fluid within the supply line 210*a* of the secondary supply loop 210 may be provided to the plurality of area zones 260 such that the area zones are properly conditioned. FIG. 14 depicts an operational example of the different types of actuation signal sets given various combinations of the determining factors.

In some embodiments, operation 1104 of FIG. 11 may be performed in accordance with the operations described in FIG. 12, which is a flowchart illustrating various example operations of a method for determining the supply temperature type in each supply line. At operation 1202, the apparatus 1500 may determine a supply temperature associated with the supply lines. As described above, each supply line of a primary supply loop 205, secondary supply loop 210, and/or auxiliary supply loop 610 may include a temperature sensor positioned in or on the respective supply line. The apparatus 1500 may be in communication with one or more of the temperature sensors such that the apparatus 1500 is provided with a temperature value indicative of the thermal transport fluid temperature flowing from within the respective supply line.

At operation 1204, the apparatus 1500 may determine the supply temperature type for each supply line based on one or more supply temperature thresholds. In some embodiments, the apparatus 1500 may be configured with one or more stored temperature thresholds which may be used to categorize or otherwise determine the supply temperature type of a respective supply loop. The one or more temperature thresholds may be indicative of a range which corresponds to a particular supply temperature type. The apparatus 1500 may then determine the supply temperature type for each supply line based on whether a corresponding supply temperature of the thermal transport fluid in each supply line satisfies one or more supply temperature thresholds. For example, a temperature threshold may be 60 degrees Fahrenheit such that the apparatus may compare the received supply temperature for a given supply line to the temperature threshold. The apparatus 1500 may determine that if the supply temperature is below 60 degrees Fahrenheit, the supply temperature type is cold and if the supply temperature is at or above 90 degrees Fahrenheit, the supply temperature type is hot.

By way of continuing example, another temperature threshold may be 120 degrees Fahrenheit such that the apparatus may compare the received supply temperature for a given supply line to the two temperature thresholds. The apparatus 1500 may determine that if the supply temperature is below 60 degrees Fahrenheit, the supply temperature type is cold, if the supply temperature is at or above 90 degrees Fahrenheit but below 120 degrees Fahrenheit, the supply temperature type is hot, and if the supply temperature is at or above 120 degrees Fahrenheit, the supply temperature type is very hot. The individual supply temperature type categories may be configured by one or more authorized users.

In some embodiments, operation 1102 of FIG. 11 may be performed in accordance with the operations described in FIG. 13, which is a flowchart illustrating various example operations of a method for determining a condition type request. At operation 1302, the apparatus 1500 may determine a supply temperature associated with the supply lines. As described above, each area zone of the plurality of area zones may be associated with a UC, configured to receive a setpoint from one or more area zone occupants. In some embodiments, the apparatus 1500 may receive one or more temperature setpoint requests from one or more area zones of the plurality of area zones. The apparatus 1500 may receive the one or more temperature setpoint requests directly or indirectly using an intermediary device, such as BAS 250.

In some embodiments, the temperature setpoint request may be received in an instance an area zone is requesting conditioning. In particular, a temperature setpoint request may be received in an instance there is a mismatch between a setpoint temperature of the UC and a measured temperature from one or more sensors associated with the area zone and in communication (directly or indirectly) with the UC.

As such, the temperature setpoint request may be indicative of a conditioning request for a respective area zone.

At operation 1304, the apparatus may determine the condition type request using a prioritization temperature request model. The condition type request may be determined based on each received temperature setpoint request. The prioritization temperature request model may be a computational model, such as a rules-based model and/or machine learning model. The prioritization temperature request model may be executed locally using the apparatus 1500 or using another external computing device, such as BAS 250. The prioritization temperature request model may be used to determine a single condition type request for the plurality of area zones associated with the DAD. Said otherwise, the prioritization temperature request model may be configured to resolve conflicting condition request types and resolve to a single condition request type.

The prioritization temperature request model may process each temperature setpoint request to determine the condition request type. In some embodiments, each temperature setpoint request may also include supplemental data, which may be indicative of a request time, a current area zone temperature, an area zone identifier which may uniquely identify the area zone from other area zones, a priority exception (e.g., a short-term special circumstance, such as a large meeting scheduled in the area zone), and/or the like. The prioritization temperature request model may be configured to determine the condition type request based on one or more of a priority score associated with each of the plurality of area zones, each received temperature setpoint request, an averaged temperature determined based on each received temperature setpoint request, or a temperature deviation from a configured set point.

For example, a particular area zone may be prioritized over the other area zones of the plurality of area zones. As such, the prioritization temperature request model may weight the temperature setpoint request associated with this prioritized area zone higher than the other area zones. As another example, the prioritization temperature request model may determine an average of each temperature setpoint value of the one or more received temperature setpoint request, received within a particular time window, to determine the condition type request. As yet another example, the prioritization temperature request model may determine a difference between the setpoint temperature and current temperature for each area zone and determine the condition type request based on the area zone with the largest difference in temperature. The apparatus 1500 may use any combination of the described examples.

The prioritization temperature request model may also use the current temperature of one or more of the area zones to determine whether a heating condition type request or a cooling condition type request should be performed. For example, if the current temperature is below a temperature setpoint determined based on one or more setpoint requests, the prioritization temperature request model may determine a heating condition type request. Alternatively, if the current temperature is above a temperature setpoint determined based on one or more setpoint requests, the prioritization temperature request model may determine a cooling condition type request. If the current temperature is exactly the temperature setpoint determined based on one or more setpoint requests, the prioritization temperature request model may determine a static condition type request, such that the apparatus 1500 does not perform further operations described in FIGS. 9-10.

According to example implementations of the present disclosure, the system 100 and its subsystems including computers 118-122 may be implemented by various computing architectures. Computing architectures for implementing the system and its subsystems may include hardware, alone or under direction of one or more computer programs (e.g., project-related software application 124) from a computer-readable storage medium. In some examples, one or more apparatuses, such as apparatus 1500, may be configured to function as or otherwise implement the system and its subsystems shown and described herein. In examples involving more than one apparatus, the respective apparatuses may be connected to or otherwise in communication with one another in a number of different manners, such as directly or indirectly via a wired or wireless network or the like.

Example Implementing Apparatus

FIG. 15 illustrates an apparatus 1500 according to some example implementations of the present disclosure. In some embodiments, the apparatus 1500 may be implemented as the DAD controller, such as DAD controller 225 depicted in FIGS. 2-8. Generally, an apparatus of exemplary implementations of the present disclosure may comprise, include or be embodied in one or more fixed or portable electronic devices. Examples of suitable electronic devices include a smartphone, tablet computer, laptop computer, desktop computer, workstation computer, server computer, PLC, circuit board or the like. The apparatus may include one or more of each of a number of components such as, for example, a processor 1502 connected to a memory 1504.

The processor 1502 is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor may be a number of processors, a multi-core processor or some other type of processor, depending on the particular implementation.

The processor 1502 may be configured to execute computer programs such as computer-readable program code 1506, which may be stored onboard the processor or otherwise stored in the memory 1504. In some examples, the processor may be embodied as or otherwise include one or more microprocessors, ASICs, FPGAs or the like. Thus, although the processor may be capable of executing a computer program to perform one or more functions, the processor of various examples may be capable of performing one or more functions without the aid of a computer program.

The memory 1504 is generally any piece of computer hardware capable of storing information such as, for example, data, computer-readable program code 1506 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 1502, causes the apparatus 1500 to perform various operations as described herein.

In addition to the memory 1504, the processor 1502 may also be connected to one or more peripherals such as a network adapter 1508, one or more input/output (I/O) devices or the like. The network adapter is a hardware component configured to connect the apparatus 1500 to one or more networks to enable the apparatus to transmit and/or receive information via the one or more networks. This may include transmission and/or reception of information via one or more networks through a wired or wireless connection using suitable wired or wireless communication protocols.

The I/O devices may include one or more input devices 1510 capable of receiving data or instructions for the apparatus 1500, and/or one or more output devices 1512 capable of providing an output from the apparatus. Examples of suitable input devices include a keyboard, keypad or the like, and examples of suitable output devices include a display device such as a one or more light-emitting diodes (LEDs), a LED display, a liquid crystal display (LCD), or the like.

CONCLUSION

As explained above and reiterated below, the present disclosure includes, without limitation, the following example implementations.

Clause 1. A method for controlling routing of hydronic flow within a climate control system, the method comprising: determining a condition type request for a plurality of area zones; determining a supply temperature type associated with at least a supply line of a primary supply loop and a supply line of a secondary supply loop, wherein: the supply temperature type is indicative of a thermal transport fluid temperature within the respective supply line; and providing an actuation signal set to a valve assembly, wherein: the actuation signal set is configured to describe a position for each valve of the valve assembly associated with the particular thermal zone, the position for each valve is based on the conditioning type request and the determined supply temperature types associated with at least a supply line of a primary supply loop and a supply line of a secondary supply loop, and the valve assembly is fluidically coupled at least to the supply line of the primary supply loop, the supply line of the secondary supply loop, and a supply line for an area zone primary unit for each of the plurality of area zones.

Clause 2. The method of clause 1, wherein determining the supply temperature type further comprises: determining a supply temperature associated with at least the supply line of the primary supply loop and the supply line of the secondary supply loop, wherein: each supply temperature is measured by a temperature sensor located on or in the supply line of the respective supply loop, and the supply temperature is a temperature of a thermal transport fluid flowing from within the respective supply line.

Clause 3. The method of clause 2, further comprising determining the supply temperature type for each supply line based on whether a corresponding supply temperature of the thermal transport fluid in each supply line satisfies one or more supply temperature thresholds.

Clause 4: The method of clause 1 to 3, wherein the supply temperature type comprises a hot supply temperature type, neutral supply temperature type, and cold supply temperature type.

Clause 5. The method of any of clauses 1 to 4, wherein determining the condition type request further comprises: receiving a temperature setpoint request from one or more area zones of the plurality of area zones; and determining, using a prioritization temperature request model, the condition type request based on each received temperature setpoint request.

Clause 6. The method of any of clauses 1 to 5, wherein the prioritization temperature request model is configured to determine the condition type request based on one or more of: a priority score associated with each of the plurality of area zones, each received temperature setpoint request, an averaged temperature determined based on each received temperature setpoint request, or a temperature deviation from a configured set point.

Clause 7. The method of any of clauses 1 to 6, wherein the condition type request comprises a cooling request or heating request.

Clause 8. The method of any of clauses 1 to 7, wherein the valve assembly is further fluidically coupled to: a return line of the primary supply loop, a return line of the secondary supply loop, and a return line for the area zone primary unit for each of the plurality of area zones.

Clause 9. The method of any of clauses 1 to 8, wherein each area zone primary unit comprises a fan coil, air handling unit, or a terminal unit.

Clause 10. The method of any of clauses 1 to 9, wherein the valve assembly comprises one or more six-way valves.

Clause 11. The method of any of clauses 1 to 10, wherein: the valve assembly is two or more six-way valves, the valve assembly is further fluidically coupled to: a supply line of an auxiliary supply loop and a return line of the auxiliary supply loop, and each six-way valve of the valve assembly are fluidically coupled to one another via a supply line and return line.

Clause 12. A computer-readable storage medium for controlled routing of hydronic flow within a climate control system, the computer-readable storage medium being non-transitory and having computer-readable program code including a software application stored therein that, in response to execution by processor, causes an apparatus to at least: determine a condition type request for a plurality of area zones corresponding to a particular thermal zone; determine a supply temperature type associated with at least a supply line of a primary supply loop and a supply line of a secondary supply loop, wherein: the supply temperature type is indicative of a thermal transport fluid temperature within the respective supply line; and provide an actuation signal set to a valve assembly, wherein: the actuation signal set is configured to describe a position for each valve of the valve assembly associated with the particular thermal zone, the position for each valve is based on the conditioning type request, and the valve assembly is fluidically coupled at least to the supply line of the primary supply loop, the supply line of the secondary supply loop, and a supply line for an area zone primary unit for each of the plurality of area zones.

Clause 13. The computer-readable storage medium of clause 12, wherein the software application, in response to execution by processor, further causes an apparatus to, when determining the supply temperature type, at least: determine a supply temperature associated with at least the supply line of the primary supply loop and the supply line of the secondary supply loop, wherein: each supply temperature is measured by a temperature sensor located on or in the supply line of the respective supply loop, and, the supply temperature is a temperature of a thermal transport fluid flowing from within the respective supply line; and determine the supply temperature type for each supply line based on whether a corresponding supply temperature of the thermal transport fluid in each supply line satisfies one or more supply temperature thresholds.

Clause 14. The computer-readable storage medium of any of clause 12 or clause 13, wherein the software application, in response to execution by processor, further causes an apparatus to, when determining the supply temperature type, at least: determine a supply temperature associated with at least the supply line of the primary supply loop and the supply line of the secondary supply loop, wherein: each supply temperature is measured by a temperature sensor located on or in the supply line of the respective supply loop, and the supply temperature is a temperature of a thermal transport fluid flowing from within the respective supply line.

Clause 15. The computer-readable storage medium of clause 14, wherein the software application, in response to execution by processor, further causes an apparatus to, at least determine the supply temperature type for each supply line based on whether a corresponding supply temperature of the thermal transport fluid in each supply line satisfies one or more supply temperature thresholds.

Clause 16. The computer-readable storage medium of any of clauses 12 to 15, wherein the supply temperature type comprises a hot supply temperature type, neutral supply temperature type, and cold supply temperature type.

Clause 17. The computer-readable storage medium of any of clauses 12 to 16, wherein the software application, in response to execution by processor, further causes an apparatus to, when determining the condition type request, at least: receive a temperature setpoint request from one or more area zones of the plurality of area zones; and determine, using a prioritization temperature request model, the condition type request based on each received temperature setpoint request.

Clause 18. The computer-readable storage medium of any of clauses 12 to 17, wherein the prioritization temperature request model is configured to determine the condition type request based on one or more of: a priority score associated with each of the plurality of area zones, each received temperature setpoint request, an averaged temperature determined based on each received temperature setpoint request, or a temperature deviation from a configured set point.

Clause 19. The computer-readable storage medium of any of clauses 12 to 18, wherein the condition type request comprises a cooling request or heating request.

Clause 20. The computer-readable storage medium of any of clauses 11 to 19, wherein the valve assembly is further fluidically coupled to: a return line of the primary supply loop, a return line of the secondary supply loop, and a return line for the area zone primary unit for each of the plurality of area zones.

Clause 21. The computer-readable storage medium of any of clauses 11 to 20, wherein each area zone primary unit comprises a fan coil, air handling unit, or a terminal unit.

Clause 22. The computer-readable storage medium of any of clauses 12 to 21, wherein the valve assembly comprises one or more six-way valves Clause 23. The computer-readable storage medium of any of clauses 12 to 22, wherein the valve assembly is two or more six-way valves, the valve assembly is further fluidically coupled to: a supply line of an auxiliary supply loop and a return line of the auxiliary supply loop, and each six-way valve of the valve assembly are fluidically coupled to one another via a supply line and return line.

Clause 24. A climate control system for controlled routing of hydronic flow, comprising: a primary supply loop, wherein: the primary supply loop comprises a supply line and a return line; a secondary supply loop, wherein: the secondary supply loop comprises a supply line and a return line; a plurality of area zones primary units, wherein: each area zone primary unit is associated with an area zone of a plurality of area zones and each area zone corresponds to a particular thermal zone; a valve assembly, wherein: the valve assembly comprises one or more valves configured to control a flow of thermal transport fluid between two corresponding lines, and the valve assembly is fluidically coupled at least to the supply line of the primary supply loop, the supply line of the secondary supply loop, and the supply line for the area zone primary unit for each of the plurality of area zones; and a distribution area direction controller, wherein the distribution area direction controller is configured to: determine a condition type request for the plurality of area zones; determine a supply temperature type associated with at least the supply line of the primary supply loop and the supply line of the secondary supply loop, wherein: the supply temperature type is indicative of a thermal transport fluid temperature within the respective supply line; and provide an actuation signal set to a valve assembly, wherein: the actuation signal set is configured to describe a position for each valve of the valve assembly associated with the particular thermal zone, and the position for each valve is based on the conditioning type request.

Clause 25. The climate control system of clause 24, wherein the valve assembly is further fluidically coupled to a return line of the primary supply loop, a return line of the secondary supply loop, and a return line for the area zone primary unit for each of the plurality of area zones.

Clause 26. The climate control system of any of clauses 24 or clause 25, wherein the condition type request comprises a cooling request or heating request.

Clause 27. The climate control system of any of clauses 24 to 26, wherein: the valve assembly is two or more six-way valves, the valve assembly is further fluidically coupled to: the supply line of the auxiliary supply loop and the return line of the auxiliary supply loop, and each six-way valve of the valve assembly are fluidically coupled to one another via a supply line and return line.

Clause 28. The climate control system of any of clauses 24 to 27, wherein the valve assembly comprises one or more six-way valves.

Clause 29. The climate control system of any of clauses 24 to 28, wherein each area zone primary unit comprises a fan coil, air handling unit, or a terminal unit.

Clause 30. The climate control system of any of clauses 24 to 29, wherein: the climate control system further comprises one or more temperature sensors located on or in the supply line of a respective supply loop, and the distribution area direction controller is further configured to: determine a supply temperature associated with at least the supply line of the primary supply loop and the supply line of the secondary supply loop, wherein: each supply temperature is measured by a corresponding temperature sensor located on or in the supply line of the respective supply loop, and the supply temperature is a temperature of a thermal transport fluid flowing from within the respective supply line.

Clause 31. The climate control system of clause 30, wherein the distribution area controller is further configured to determine the supply temperature type for each supply line based on whether the corresponding supply temperature satisfies one or more supply temperature thresholds.

Clause 32. The climate control system of any of clauses 24 to 30, wherein the supply temperature type comprises a hot supply temperature type, neutral supply temperature type, and cold supply temperature type.

Clause 33. The climate control system of any of clauses 24 to 32, wherein the distribution area direction controller is further configured to: receive a temperature setpoint request from one or more area zones; and determine, using a prioritization temperature request model, the condition type request based on each received temperature setpoint request.

Clause 34. The climate control system of any of clauses 24 to 34, wherein the prioritization temperature request model is configured to determine the condition type request based on one or more of a priority score associated with each of the plurality of area zones, each received temperature setpoint request, an averaged temperature determined based on each received temperature setpoint request, or a temperature deviation from a configured set point.

Clause 35. The climate control system of any of clauses 24 to 34, wherein the supply temperature type comprises a hot supply temperature type, neutral supply temperature type, and cold supply temperature type.

Clause 36. The climate control system of any of clauses 24 to 35, wherein one or more area zones of the plurality of area zones further comprises an area zone secondary unit.

Clause 37. The climate control system of any of clauses 24 to 36, wherein each area zone secondary unit is fluidically coupled to one of: a secondary supply line of the primary supply loop and a secondary return line of the primary supply loop, a secondary supply line of the secondary supply loop and a secondary return line of the secondary supply loop, or a secondary supply line of an auxiliary supply loop and a secondary return line of an auxiliary supply loop.

Clause 38. The climate control system of any of clauses 24 to 37, wherein the distribution area direction controller is further configured to: determine another condition type request for a plurality of area zones corresponding to another thermal zone; and provide an actuation signal set to the valve assembly, wherein: the actuation signal set is configured to describe a position for each valve of the valve assembly associated with the another thermal zone, and the position for each valve is based on the another conditioning type request and the determined supply temperature types.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed is:

1. A method for controlling routing of hydronic flow within a climate control system, the method comprising:

determining a condition type request for a plurality of area zones corresponding to a particular thermal zone;

determining a supply temperature type associated with at least a supply line of a primary supply loop and a supply line of a secondary supply loop, wherein the supply temperature type is indicative of a thermal transport fluid temperature within the respective supply line and at least one the supply line of the primary loop and the supply line of the secondary loop has a supply temperature type that changes over time; and providing an actuation signal set to a valve assembly, wherein the actuation signal set is configured to describe a position for each valve of the valve assembly associated with the particular thermal zone, the position for each valve is based on the conditioning type request and the determined supply temperature types, and the valve assembly is fluidically coupled at least to the supply line of the primary supply loop, the supply line of the secondary supply loop, and a supply line for an area zone primary unit for each of the plurality of area zones, wherein the valve assembly is two or more six-way valves, the valve assembly is further fluidically coupled to a supply line of an auxiliary supply loop and a return line of the auxiliary supply loop, and each six-way valve of the valve assembly are fluidically coupled to one another via a supply line and return line.

2. The method of claim 1, wherein determining the supply temperature type further comprises:

determining a supply temperature associated with at least the supply line of the primary supply loop and the supply line of the secondary supply loop, wherein:

each supply temperature is measured by a temperature sensor located on or in the supply line of the respective supply loop, and the supply temperature is a temperature of a thermal transport fluid flowing from within the respective supply line.

3. The method of claim 2, further comprising:
determining a second condition type request.

4. The method of claim 1, wherein the supply temperature type is one of hot.

5. The method of claim 1, wherein determining the condition type request further comprises:
receiving a temperature setpoint request from one or more area zones of the plurality of area zones; and
determining, using a prioritization temperature request model, the condition type request based on each received temperature setpoint request.

6. The method of claim 5, wherein the prioritization temperature request model is configured to determine the condition type request based on one or more of: a priority score associated with each of the plurality of area zones, each received temperature setpoint request, an averaged temperature determined based on each received temperature setpoint request, or a temperature deviation from a configured set point.

7. The method of claim 1, wherein the condition type request comprises a cooling request or heating request.

8. The method of claim 1, wherein the valve assembly is further fluidically coupled to: a return line of the primary supply loop, a return line of the secondary supply loop, and a return line for the area zone primary unit for each of the plurality of area zones.

9. The method of claim 1, wherein each area zone primary unit comprises a fan coil, air handling unit, or a terminal unit.

10. The method of claim 1, wherein the valve assembly comprises one or more six-way valves.

11. A climate control system for controlled routing of hydronic flow, comprising:
a primary supply loop, wherein:
the primary supply loop comprises a supply line and a return line;
a secondary supply loop, wherein:
the secondary supply loop comprises a supply line and a return line;
a plurality of area zones primary units, wherein:
each area zone primary unit is associated with an area zone of a plurality of area zones and each area zone corresponds to a particular thermal zone;
a valve assembly, wherein:
the valve assembly comprises one or more valves configured to control a flow of thermal transport fluid between two corresponding lines,
the valve assembly is two or more six-way valves, each six-way valve of the valve assembly are fluidically coupled to one another via a supply line and return line, and
the valve assembly is fluidically coupled at least to the supply line of the primary supply loop, the supply line of the secondary supply loop, and a supply line for the area zone primary unit for each of the plurality of area zones;
an auxiliary supply loop, wherein:
the auxiliary supply loop comprises a supply line and a return line, and
the valve assembly is further fluidically coupled to the supply line of the auxiliary supply loop and the return line of the auxiliary supply loop; and
a controller, wherein the controller is configured to:
determine a condition type request for the plurality of area zones corresponding to a particular thermal zone;
determine a supply temperature type associated with at least the supply line of the primary supply loop and the supply line of the secondary supply loop, wherein the supply temperature type is indicative of a thermal transport fluid temperature within the respective supply line and at least one the supply line of the primary loop and the supply line of the secondary loop has a supply temperature type that changes over time; and
provide an actuation signal set to the valve assembly, wherein:
the actuation signal set is configured to describe a position for each valve of the valve assembly associated with the particular thermal zone, and
the position for each valve is based on the conditioning type request and the determined supply temperature types.

12. The climate control system of claim 11, wherein the valve assembly is further fluidically coupled to a return line of the primary supply loop, a return line of the secondary supply loop, and a return line for the area zone primary unit for each of the plurality of area zones.

13. The climate control system of claim 11, wherein the condition type request comprises a cooling request or heating request.

14. The climate control system of claim 11, wherein the valve assembly comprises one or more six-way valves.

15. The climate control system of claim 11, wherein each area zone primary unit comprises a fan coil, air handling unit, or a terminal unit.

16. The climate control system of claim 11, wherein:
the climate control system further comprises one or more temperature sensors located on or in the supply line of a respective supply loop, and
the controller is further configured to:
determine a supply temperature associated with at least the supply line of the primary supply loop and the supply line of the secondary supply loop, wherein:
each supply temperature is measured by a corresponding temperature sensor located on or in the supply line of the respective supply loop, and
the supply temperature is a temperature of a thermal transport fluid flowing from within the respective supply line.

17. The climate control system of claim 16, wherein the controller is further configured to determine the supply temperature type for each supply line based on whether the corresponding supply temperature satisfies one or more supply temperature thresholds.

18. The climate control system of claim 11, wherein the controller is further configured to:
receive a temperature setpoint request from one or more area zones; and
determine, using a prioritization temperature request model, the condition type request based on each received temperature setpoint request.

19. The climate control system of claim 18, wherein the prioritization temperature request model is configured to determine the condition type request based on one or more of a priority score associated with each of the plurality of area zones, each received temperature setpoint request, an averaged temperature determined based on each received temperature setpoint request, or a temperature deviation from a configured set point.

20. The climate control system of claim 11, wherein one or more area zones of the plurality of area zones further comprises an area zone secondary unit.

21. The climate control system of claim 20, wherein each area zone secondary unit is fluidically coupled to one of: a secondary supply line of the primary supply loop and a secondary return line of the primary supply loop, a secondary supply line of the secondary supply loop and a secondary return line of the secondary supply loop, or a secondary supply line of an auxiliary supply loop and a secondary return line of an auxiliary supply loop.

22. The climate control system of claim 11, wherein the controller is further configured to:

determine another condition type request for a plurality of area zones corresponding to another thermal zone; and provide an actuation signal set to the valve assembly, wherein:

the actuation signal set is configured to describe a position for each valve of the valve assembly associated with the another thermal zone, and the position for each valve is based on the another conditioning type request and the determined supply temperature types.

23. The method of claim 1, wherein the valve assembly comprises a six-way valves, the six-way valve including two or more valves.

24. The climate control system of claim 11, wherein the valve assembly comprises a six-way valves, the six-way valve including two or more valves.

25. The climate control system of claim 11, wherein the controller is at least one of a distribution area direction controller or a building automation system controller.

* * * * *